US006309050B1

(12) United States Patent
Ikeda et al.

(10) Patent No.: US 6,309,050 B1
(45) Date of Patent: Oct. 30, 2001

(54) INK JET RECORDING APPARATUS HAVING DEFLECTION MEANS FOR DEFLECTING DROPLETS OF INK EMITTED THROUGH A NOZZLE

(75) Inventors: Koji Ikeda; Atsushi Sogami, both of Hyogo; Akira Fukano, Nara, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/385,017

(22) Filed: Aug. 30, 1999

(30) Foreign Application Priority Data

Sep. 8, 1998 (JP) ..... 10-253986

(51) Int. Cl.[7] ..... B41J 2/06; B41J 2/35; B41J 2/14

(52) U.S. Cl. ..... 347/55; 347/44; 347/47

(58) Field of Search ..... 347/10, 11, 15, 347/20, 40, 37, 39, 41, 47, 54, 55, 68, 44

(56) References Cited

U.S. PATENT DOCUMENTS

| | | | | |
|---|---|---|---|---|
| 3,714,928 | * | 2/1973 | Taylor | 347/47 |
| 4,189,734 | * | 2/1980 | Kyser et al. | 347/47 |
| 4,386,358 | * | 5/1983 | Fischbeck | 347/55 |
| 4,642,653 | * | 2/1987 | Ito et al. | 347/15 |
| 4,714,935 | * | 12/1987 | Yamamoto et al. | 347/68 |
| 5,670,996 | * | 9/1997 | Mitani | 347/29 |
| 5,689,291 | * | 11/1997 | Tence et al. | 347/68 |
| 5,917,518 | * | 6/1999 | Ohashi et al. | 347/37 |
| 5,929,879 | * | 7/1999 | Karita et al. | 347/47 |
| 5,946,011 | * | 8/1999 | Kanaya | 347/37 |
| 5,975,683 | * | 11/1999 | Smith et al. | 347/55 |
| 5,992,968 | * | 11/1999 | Uetsuki et al. | 347/47 |

FOREIGN PATENT DOCUMENTS

| | | | |
|---|---|---|---|
| 5-278212 | 10/1993 | (JP) | B41J/2/15 |

* cited by examiner

*Primary Examiner*—John Barlow
*Assistant Examiner*—Robert Loper, Jr.
(74) *Attorney, Agent, or Firm*—Eric J. Robinson; Nixon Peabody LLP

(57) ABSTRACT

A nozzle of an ink jet head is formed such that a droplet of ink is emitted in a direction nonparallel to a virtual plane formed by a scanning direction X and an electric field direction Z. A voltage is applied between a nozzle plate and a facing electrode for creating an electric field. First and second ink droplets are emitted from the same nozzle during one print cycle. The first ink droplet is emitted in an uncharged state in order not to be deflected by the electric field. On the other hand, the second ink droplet is emitted in a charged state in order to be deflected by the electric field. Because of the difference in deflection amount, the landing positions of the first and second ink droplets are varied, whereby dot density can be improved to be twice as great as nozzle density.

25 Claims, 27 Drawing Sheets

INK JET RECORDING APPARATUS HAVING DEFLECTION MEANS FOR DEFLECTING DROPLETS OF INK EMITTED THROUGH A NOZZLE

FIELD OF THE INVENTION

The present invention relates to an ink jet recording apparatus. More particularly, the invention relates to an ink jet recording apparatus having a deflection means for deflecting droplets of ink emitted through a nozzle.

BACKGROUND OF THE INVENTION

Personal computer printers and the like employ ink jet recording technology. Ink jet recording apparatus have several advantages, such as easy handling, superior print performance, and low cost. Because of these benefits, ink jet recording apparatus have now become widespread. There exist various types of ink jet recording apparatus and they are classified according to how ink droplet is emitted. For example, there is an ink jet recording apparatus of the thermal type in which thermal energy is utilized to create a bubble in ink, and a droplet of the ink is emitted by a pressure wave caused by the created bubble. There is another ink jet recording apparatus of the electrostatic type in which an ink droplet is sucked and emitted by electrostatic force. There is still another ink jet recording apparatus of the piezoelectric type in which an ink droplet is ejected by means of an oscillator such as a piezoelectric element. In addition to these ink jet recording types, Japanese Unexamined Patent Gazette No. H05-278212 further discloses an ink jet recording apparatus which is a combination of the piezoelectric type and the electrostatic type.

Whichever of the foregoing ink jet recording types is employed, ink droplets are emitted from many nozzles formed in an ink jet head in an ink jet recording apparatus. These emitted ink droplets land on a sheet of recording paper to form an ink dot. Then, by properly arranging many dots, printing of characters or images is performed on the recording paper sheet.

However, in a typical ink jet recording apparatus, the number of ink droplets each nozzle emits during one print cycle is limited to one. This means that dot density (i.e., the number of dots per unit area) depends upon nozzle density (i.e., the number of nozzles formed in an ink jet head per unit area). Therefore, in order to provide an improved dot density, the nozzle density must be improved.

However, with conventional ink jet head structures, it is difficult to provide improved nozzle densities for cost reasons. Accordingly, it has been considered that rapid improvement in dot density is difficult to achieve.

Further, another problem arises. That is to say, the landing positions of ink droplets emitted through each nozzle align in line in a scanning direction. This results in the occurrence of a so-called white stripe due to the deviation of landing positions in a direction normal to the scanning direction, and due to the variation in ink-droplet emission volume among nozzles. Such white striping causes the quality of printing of characters and images to deteriorate.

Bearing in mind the above-described problems with the prior art techniques, the present invention was made. Accordingly, an object of the invention is to provide improvement in the quality of printing of characters or images by heightening the dot density or by reducing the occurrence of white striping.

SUMMARY OF THE INVENTION

According to the present invention, the landing positions of droplets of ink emitted from nozzles are properly altered in a direction normal to a scanning direction.

More specifically, an ink jet recording apparatus in accordance with the present invention comprises (a) an ink jet head having a nozzle through which a droplet of ink is emitted, (b) a relative movement means for causing the ink jet head and a recording medium placed face to face with the nozzle to relatively move in a scanning direction, with a specified clearance maintained between the nozzle and the recording medium, (c) a facing electrode disposed face to face with the nozzle in such a way as to put the recording medium between the nozzle and the facing electrode, and (d) a voltage applying means for electrifying an ink droplet emitted from the nozzle and for applying a voltage between the nozzle and the facing electrode thereby to create an electric field, wherein the nozzle is formed in such a way as to emit an ink droplet in a direction nonparallel with a virtual plane formed by the scanning direction and the direction of the electric field, and wherein a landing position varying means is provided which is capable of freely varying the landing position of an ink droplet emitted from the nozzle in a direction normal to the scanning direction on the recording medium.

As a result of such arrangement, (i) the relative movement means relatively moves the ink jet head and the recording medium in a scanning direction, (ii) the ink jet head emits an ink droplet for each given print cycle, and (iii) characters, images, or the like are recorded on the recording medium. An ink droplet is emitted in a direction nonparallel with a virtual plane formed by the scanning direction and the direction of the created electric field. When the voltage applying means is actuated, the ink droplet is electrified, so that its flying direction is deflected by an electric field created between the nozzle and the facing electrode, and then the landing position of the ink droplet is altered in a direction normal to the scanning direction by the landing position varying means. Accordingly, it is possible to set the landing position of ink droplets which are emitted from the same nozzle at a plurality of landing points according to whether an ink droplet is charged or uncharged or by making a change in ink droplet charge amount. This makes it possible to heighten the dot density above the nozzle density as well as to suppress the occurrence of white striping.

An arrangement, as shown in, for example, FIG. 6, may be made, wherein the ink jet head has a nozzle row of a plurality of nozzles arranged in a direction normal to the scanning direction and the ink jet head is constructed such that each of the plurality of nozzles is capable of emitting two or more ink droplets during a print cycle of a given interval of time and wherein the landing position varying means is constructed such that the two or more ink droplets emitted from each of the plurality of nozzles during the print cycle land on different landing positions along a direction normal to the scanning direction on the recording medium.

As a result of such arrangement, during one print cycle two or more ink droplets are emitted from each of the nozzles of the ink jet head. Each ink droplet lands on different landing positions along a direction normal to a principal scanning direction on the recording medium, as a result of which the number of dots thus created exceeds the number of nozzles. Accordingly, the dot density is rapidly improved.

An arrangement, as shown in, for example, FIG. 9, may be made, wherein the landing position varying means is constructed such that the voltage applying means applies a plurality of voltages of different levels during one print cycle.

As described above, the voltage applying means applies, during one print cycle, a plurality of voltages of different levels. As a result of such voltage application, the landing point of each ink droplet is altered depending on the voltage level. To sum up, if a plurality of voltages of different levels are applied during one print cycle, this makes it possible to alter the landing point of each ink droplet according to the voltage level, which facilitates altering the landing points of ink droplets.

An arrangement, as shown in, for example, FIG. 9, may be made, in which voltages which are applied by the voltage applying means are set in such a way as to vary at a period of 1/n of the print cycle, where the number n is a natural number equal to or greater than two.

Accordingly, the voltage applying means varies a voltage which is applied at a period of 1/n of the print cycle, as a result of which the landing point of each ink droplet is varied at a period of 1/n in synchronization with the print period.

In the way described above, if a voltage which is applied is varied at a period of 1/n of the print cycle, then the landing point of each ink droplet can be varied at a period of 1/n in synchronization with the print period.

An arrangement, as shown in, for example, FIG. 9, may be made, in which a voltage which is applied by the voltage applying means during a print cycle is set in such a manner as to gradually increase in voltage level.

As described above, the voltage applying means applies a voltage in such a manner that the applied voltage can gradually be increased in voltage level. Because of such arrangement, ink droplets are emitted in decreasing order of deflection amount, as a result of which the landing position deviation of the ink droplets accompanied with relative movement between the ink jet head and the recording medium is reduced.

An arrangement, as shown in, for example, in FIG. 13 or FIG. 15, may be made, wherein the plurality of voltages which are applied by the voltage applying means during one print cycle include first and second voltages which differ in voltage level each other and wherein at least one of the first and second voltages is set in such a way to vary over a plurality of print cycles.

As described above, the voltage applying means varies at least one of the first and second voltages which are applied during one print cycle over a plurality of print cycles. Accordingly, the ink droplet landing point is varied over a plurality of print cycles correspondingly to the first voltage or the second voltage, whichever is varied. As a result, the occurrence of white striping is suppressed.

An arrangement, as shown in, for example, FIG. 3, may be made, wherein (a) the ink jet head has a plurality of nozzle rows arranged parallel with one another at given intervals of L in the scanning direction, (b) the relative movement means is constructed such that the ink jet head and the recording medium are relatively moved at a given relative velocity v, and (c) at least one of the first and second voltages which are applied by the voltage applying means is set in such a way as to vary at a period of $T1=v/L\times n$, where the number n is a natural number.

As a result of such arrangement, ink droplets emitted from the plurality of nozzle rows are varied synchronously with one another. As a result, for example, when ink droplets of a plurality of colors are emitted through a plurality of nozzle rows, color deviation due to the overlapping of ink droplets is prevented.

An arrangement, as shown in, for example, FIG. 11, may be made, wherein the plurality of voltages which are applied by the voltage applying means comprise voltages of the same polarity.

As described above, making utilization of a plurality of voltages of the same polarity, the voltage applying means performs variation in applied voltage. As a result, alteration of the landing point is carried out not by voltage ON/OFF control but by voltage variation control. For the case of voltages of different polarities, there may occur an undesirable situation in which ink droplets are not accelerated but decelerated by an electrostatic field. Such a situation can be prevented.

An arrangement, as shown in, for example, FIG. 4, may be made, wherein (a) the ink jet head has an pressure chamber in communication with the nozzle for containing therein ink and pressurizing means for applying a pressure to the ink held in the pressure chamber so that the ink is emitted in the form of an ink droplet through the nozzle and (b) the landing position varying means is implemented by pressure varying means capable of varying the amount of pressure of the pressuring means so that the nozzle is able to freely emit a plurality of ink droplets of different emission velocities during one print cycle.

Accordingly, the pressurizing means applies a pressure to ink held in the pressure chamber, and by virtue of such an applied pressure a droplet of the ink is emitted from the nozzle. The landing position varying means varies the pressure amount of the pressurizing means during one print cycle. As a result, during one print cycle a plurality of ink droplets of different emission velocities are emitted. Since an ink droplet of a high emission velocity has a shorter landing time, the amount of deflection thereof caused by an electric field is small. On the other hand, since an ink droplet of a low emission velocity has a longer landing time, the amount of deflection thereof caused by an electric field is great. As a result, there are made changes in landing position according to the difference in emission velocity between ink droplets. This facilitates changing the landing positions of ink droplets.

An arrangement, as shown in, for example, FIGS. 18(*a*) and 18(*b*), may be made, wherein the pressure varying means is constructed such that, during one print cycle, a plurality of ink droplets are emitted from the same nozzle at the same emission volume and at different emission velocities.

Accordingly, by virtue of the pressuring varying means, during one print cycle, a plurality of ink droplets of the same emission amount as well as of different emission velocities are emitted. The ink droplets thus emitted are identical in emission amount with one another, therefore forming their respective dots of the same diameter on the recording medium. On the other hand, these ink droplets differ in emission velocity from one another, so that the landing positions thereof become altered. Accordingly, it is possible to form on the recording medium dots of the same diameter while altering the landing position of an ink droplet.

An arrangement may be made, wherein (a) the pressure varying means is constructed such that a plurality of ink droplets emitted from the same nozzle during one print cycle form at least first and second dots of the same diameter on the recording medium, (b) the first dot is formed of two or more ink droplets, while the second dot is formed of a single ink droplet, and (c) each of the ink droplets together forming the first dot each is emitted at a lower emission velocity in comparison with the droplet forming the second dot.

As describe above, by virtue of the pressure varying means, a plurality of ink droplets are emitted during one print cycle, wherein a first dot is formed of two or more ink droplets, while a second dot is formed of a single ink droplet.

The first dot is formed of two or more ink droplets. Therefore, when forming first and second dots of the same diameter, there is no need to emit ink droplets for forming these two dots at the same emission velocity. In other words each of ink droplets forming a first dot and an ink droplet forming a second dot can be emitted at different emission velocities, which therefore facilitates forming both the first and second dots.

An arrangement may be made, wherein the pressurizing means is constructed such that the pressure amount varies at a period of 1/n of a print cycle, where the number n is a natural number equal to or greater than two.

Accordingly, by virtue of the pressurizing means, the pressure amount is made to vary at a period of 1/n of a print cycle. As a result, the landing positions of ink droplets are altered at a period of 1/n in synchronization with the print cycle. Accordingly, it becomes possible to alter the landing positions of ink droplets at a period of 1/n in synchronization with the print cycle.

An arrangement may be made, wherein the pressurizing means is constructed such that the pressure amount gradually increases during each print cycle.

As described above, the pressurizing means increases the amount of pressure little by little. Accordingly, ink droplets will be emitted in decreasing order of deflection amount, as a result of which the landing position deviation of the ink droplets accompanied with relative movement between the ink jet head and the recording medium is reduced.

An arrangement may be made, wherein (a) the pressuring means includes an oscillating plate which forms at least one of walls of the pressure chamber and a piezoelectric element for displacing the oscillating plate upon application of a voltage to the piezoelectric element, and (b) the pressure varying means is constructed such that the amount of pressure by the oscillating plate is varied by varying the waveform of a voltage which is applied to the piezoelectric element.

Accordingly, application of a voltage to the piezoelectric element causes the oscillating plate to make a displacement, so that ink in the pressure chamber is placed under pressure. The pressure varying means changes the waveform of a voltage to be applied to the piezoelectric element, thereby to vary the amount of pressure by the oscillating plate. As a result, there is made a change in the pressure of the ink in the pressure chamber, so that droplets of the ink are emitted at different emission velocities.

An arrangement, as shown in, for example, FIGS. 20(*a*) and 20(*b*), may be made, wherein the landing position varying means is formed by a charge amount varying means for varying the amount of ink droplet electrification so as to freely emit a plurality of ink droplets of different charge amounts during one print cycle.

As described above, by virtue of the charge amount varying means, a plurality of ink droplets which are emitted during one print cycle are electrified so as to have different charge amounts. An ink droplet having a large charge amount is large in the amount of deflection by an electric field. On the other hand, an ink droplet having a small charge amount is small in the amount of deflection by an electric field. Accordingly, the landing positions of ink droplets are altered according to the difference in the amount of charge.

An arrangement may be made, wherein the charge amount varying means is constructed such that the amount of charge which is given during each print cycle gradually increases.

As described above, by virtue of the charge amount varying means, the amount of charge which is given during each print cycle is increased gradually. As a result of such an arrangement, ink droplets will be emitted in decreasing order of deflection amount, as a result of which the landing position deviation of the ink droplets accompanied with relative movement between the ink jet head and the recording medium is reduced.

An arrangement, as shown in, for example, FIGS. 21(*a*) and 21(*b*), may be made, wherein the nozzle of the ink jet head is formed such that an ink droplet is emitted in a direction nonparallel with a virtual plane perpendicular to the scanning direction.

Accordingly, ink droplets are emitted not only in a direction nonparallel with a virtual plane formed by the scanning direction and the direction of an electric field, but also in a direction nonparallel with a virtual plane perpendicular to the scanning direction. Although an ink droplet low in emission velocity has a longer landing time in comparison with an ink droplet high in emission velocity, and tends to undergo a greater landing point deviation accompanied with relative movement between the ink jet head and the recording medium, such an ink droplet undergoes a greater deviation by an electric field in comparison with an ink droplet large in size. Therefore, landing point deviation in the scanning direction due to the difference in emission velocity will be suppressed.

An arrangement, as shown in, for example, FIG. 23, may be made, wherein (a) the ink jet head has a nozzle row of a plurality of nozzles arranged at a given pitch of P in a direction normal to the scanning direction and the ink jet head is constructed such that each of the plurality of nozzles is able to emit n ink droplets during a print cycle of a given interval of time, where the number n is a natural number equal to or greater than two and (b) the landing position varying means is constructed such that landing positions of n ink droplets emitted through each of the plurality of nozzles during the print cycle are deviated by P/n in a direction normal to said scanning direction.

Accordingly, it is arranged such that n ink droplets emitted during one print cycle land on their respective positions deviated from one another by an amount of P/n in a direction normal to the scanning direction. As a result, a row of dots arranged at equal intervals is formed on the recording medium.

An arrangement, as shown in, for example, FIG. 24, may be made, wherein (a) the ink jet head has a nozzle row of a plurality of nozzles arranged at a given pitch of P in a direction normal to the scanning direction and the ink jet head is constructed such that each of the plurality of nozzles is able to emit n ink droplets during a print cycle of a given interval of time where the number n is a natural number equal to or greater than two, and (b) the landing position varying means is constructed such that landing positions of n ink droplets emitted through each of the plurality of nozzles during the print cycle are deviated by $P \times m + P/n$ in a direction normal to the scanning direction, where the number m is a natural number.

Accordingly, it is arranged such that n ink droplets emitted during one print cycle land on their respective positions deviated from one another by an amount of $P \times m + P/n$. As a result, a dot formed without landing position alteration and a dot formed with landing position alternation are not arranged next to each other, therefore suppressing the occurrence of white striping.

An arrangement, as shown in, for example, FIG. 25, may be made, wherein (a) the ink jet head has a nozzle row of a plurality of nozzles arranged at a given pitch of P in a direction normal to the scanning direction, and the ink jet head is constructed such that each of the plurality of nozzles is able to emit two ink droplets during a print cycle of a given interval of time, (b) the landing position varying means is constructed such that the landing positions of two ink droplets which are emitted from each of the plurality of nozzles can be varied among first to third landing points deviated each other by P/2 in a direction normal to the scanning direction on the recording medium, and in a first print cycle, two ink droplets which are emitted from each of the plurality of nozzles land on the first and second landing points respectively, while in a second print cycle posterior to the first print cycle, two ink droplets which are emitted from each of the plurality of nozzles land on the second and third landing points respectively, and (c) the first and second print cycles are set so as to be repeated in an alternating manner.

Accordingly, in the first print cycle ink droplets land on the first and second landing points, respectively. On the other hand, in the following second print cycle ink droplets land on the second and third landing points, respectively. As a result of such arrangement, ink droplets will not land on the same landing point over a plurality of print cycles, thereby suppressing the occurrence of white striping.

An arrangement, as shown in, for example, FIG. 26, may be made, wherein (a) the ink jet head has a nozzle row of a plurality of nozzles arranged at a given pitch of P in a direction normal to the scanning direction, and the ink jet head is constructed such that each of the plurality of nozzles can emit two ink droplets during a print cycle of a given interval of time, (b) the landing position varying means is constructed such that the landing positions of two ink droplets emitted from each of the plurality of nozzles can be varied among a first landing point on the recording medium, a second landing point deviating from the first landing point by an amount of 0.5 P in a direction normal to the scanning direction, and a third landing point deviating from the first landing point by an amount of 1.5 P in the direction normal to the scanning direction, and in a first print cycle, two ink droplets emitted from each of the plurality of nozzles land on the first and second landing points respectively, while in a second print cycle posterior to the first print cycle, two ink droplets emitted from each of the plurality of nozzles land on the second and third landing points respectively, and (c) the first and second print cycles are set so as to be repeated in an alternating manner.

Accordingly, in the first print cycle ink droplets land on the first and second landing points, respectively. On the other hand, in the following second print cycle ink droplets land on the second and third landing points, respectively. As a result of such arrangement, ink droplets will not land on the same landing point over a plurality of print cycles, thereby suppressing the occurrence of white striping.

An arrangement, as shown in, for example, FIGS. 29(*a*) and 29(*b*), may be made, wherein (a) the ink jet head includes at least first and second nozzle rows, each of the first and second nozzle rows comprising a plurality of nozzles arranged at a given pitch P in a direction normal to the scanning direction, and the ink jet head is constructed such that each nozzle can freely emit at least two ink droplets during a print cycle of a given interval of time, (b) the first nozzle row includes a first nozzle for forming at least first and second dots on the recording medium, (c) the second nozzle row includes a second nozzle adjacent to said first nozzle for forming at least third and fourth dots on the recording medium, and (d) the second dot is set to lie between the third dot and the fourth dot, while the third dot is set to lie between the first dot and the second dot.

As a result of such arrangement, the second dot is placed between the third and fourth dots, while the third dot is placed between the first and second dots. Accordingly, ink droplets emitted from the same nozzle will not land on adjoining landing points. As a result, there is provided improvement in the dot density because of the provision of a plurality of nozzle rows and the occurrence of white striping will be suppressed.

An arrangement, as shown, for example, FIGS. 30(*a*) and 30(*b*), may be made, wherein the landing position varying means is constructed such that, in order to form a dot which is elongated in a direction normal to the scanning direction on said recording medium, a plurality of ink droplets which are emitted from each nozzle during one print cycle land on the recording medium in an overlapping manner while being deviated in the direction normal to the scanning direction.

An arrangement, as shown in, for example, FIGS. 31(*a*) and 31(*b*), may be made, wherein (a) the ink jet head is constructed such that each of the nozzles can emit first and second ink droplet groups during one print cycle, each of the first and second ink droplet groups being formed of two or more ink droplets, (b) it is set such that the ink droplets of the first ink droplet group each land on the recording medium in an overlapping manner while being deviated in the scanning direction, to form on the recording medium a first dot which is elongated in the scanning direction, and (c) the ink droplets of the second ink droplet group each are emitted after the emission of the first ink droplet group in such a way as to differ in landing point from the first ink droplet group, and land on the recording medium in an overlapping manner while being deviated in said scanning direction, thereby to form a second dot which is elongated in the scanning direction at a position located at a given interval apart from the first dot in a direction normal to the scanning direction.

An arrangement, as shown in, for example, FIG. 31, may be made, wherein (a) the ink jet head is constructed such that each of the nozzles can emit first and second ink droplet groups during one print cycle, each of the first and second ink droplet groups being formed of two or more ink droplets, (b) it is set such that the ink droplets of the first ink droplet group each land on the recording medium in an overlapping manner while being deviated in the scanning direction, to form on the recording medium a first dot which is elongated in the scanning direction, and (c) the ink droplets of the second ink droplet group each are emitted after the emission of the first ink droplet group in such a way as to differ in landing point from the first ink droplet group, and land on the recording medium in an overlapping manner while being deviated in said scanning direction, thereby to form a second dot which is elongated in the scanning direction at a position located a given interval apart from the first dot in a direction normal to the scanning direction.

As a result of such arrangement, first and second dots which are elongated in the scanning direction are formed at given intervals in a direction normal to the scanning direction, thereby making it possible to provide multi-gradation recording by overlapping ink droplets. Further, the second ink droplet group is emitted after the first ink droplet group, therefore reducing the length of each dot in scanning direction.

An arrangement, as shown in, for example, FIG. 27, may be made, wherein (a) the ink jet head includes a nozzle row of a plurality of nozzles arranged in a direction normal to the scanning direction, (b) the ink jet head is constructed such that each of the plurality of nozzles can freely emit a single ink droplet during a print cycle of a given interval of time, and (c) the landing position varying means is constructed such that the landing position of each of the ink droplets with respect to the recording medium is varied in a direction normal to the scanning direction for each print cycle.

As a result of such arrangement, each nozzle emits one ink droplet during one print cycle. The landing position of each ink droplet is varied for each print cycle in a direction normal to the scanning direction, therefore suppressing the occurrence of a white stripe.

DESCRIPTION OF THE PREFERRED EMBODIMENTS

Preferred embodiments of the present invention will be described below by making reference to the attached drawings.

Embodiment 1

Structure of the Ink Jet Recording Apparatus

Figure 1:
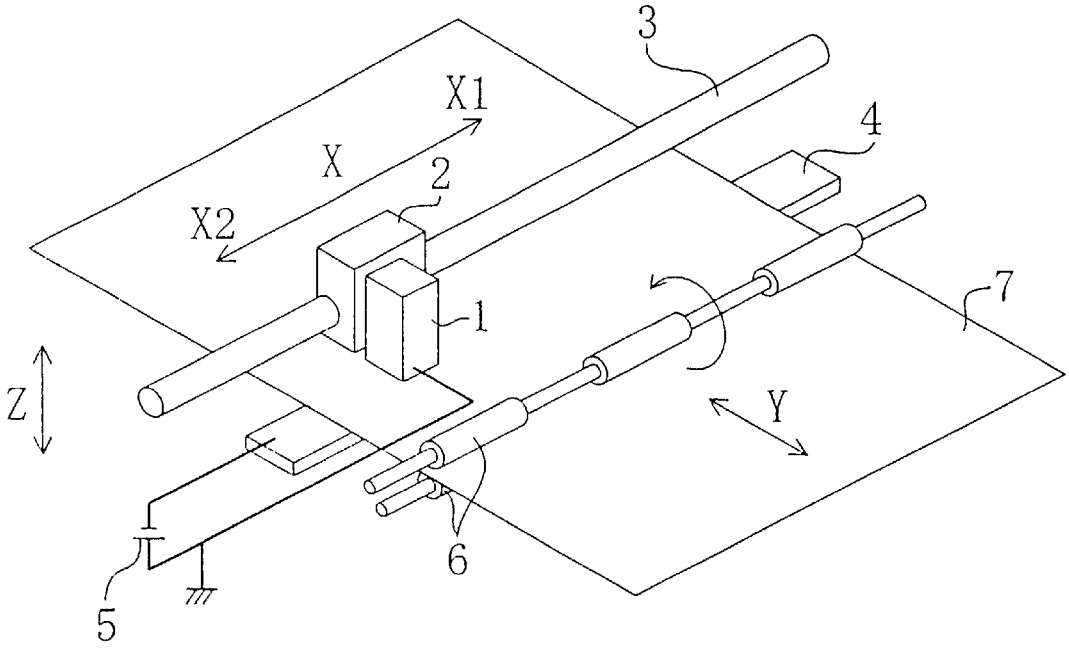
FIG. 1 is a diagram roughly showing a structure of an ink jet recording apparatus.

FIG. 1 is a diagram illustrating the structure of an ink jet recording apparatus formed according to a first embodiment of the invention. As shown in FIG. 1, a carriage 2 is constructed such that the carriage 2 is reciprocated by a drive motor (not shown) while being guided by a carriage shaft 3. An ink jet head 1 is mounted on the carriage 2, so that the ink jet head 1 travels in a principal scanning direction X of FIG. 1 together with the carriage 2. The principal scanning direction X corresponds to what is defined as a scanning direction in the present invention. Both the carriage 2 and the carriage shaft 3 are disposed on a major surface side of a recording paper sheet 7 (defined as a recording medium in the present invention), and correspond to what is defined as a relative movement means in the invention. Disposed on the opposite surface side of the recording paper sheet 7 is a facing electrode 4 of metal. It is set such that the facing electrode 4 and the ink jet head 1 are spaced apart from each other by a distance of about 1 mm. The side of the ink jet head 1 is grounded, and a voltage of −2 kV is applied by a power supply 5 between the facing electrode 4 and the ink jet head 1. This power supply 5 corresponds to what is defined as a voltage applying means in the present invention. Reference numeral 6 indicates a paper feeding roller. The paper feeding roller 6 conveys the recording paper sheet 7 in a secondary scanning direction normal to the principal scanning direction, i.e., in a direction Y of FIG. 1 perpendicular to the carriage shaft 3.

Figure 2:
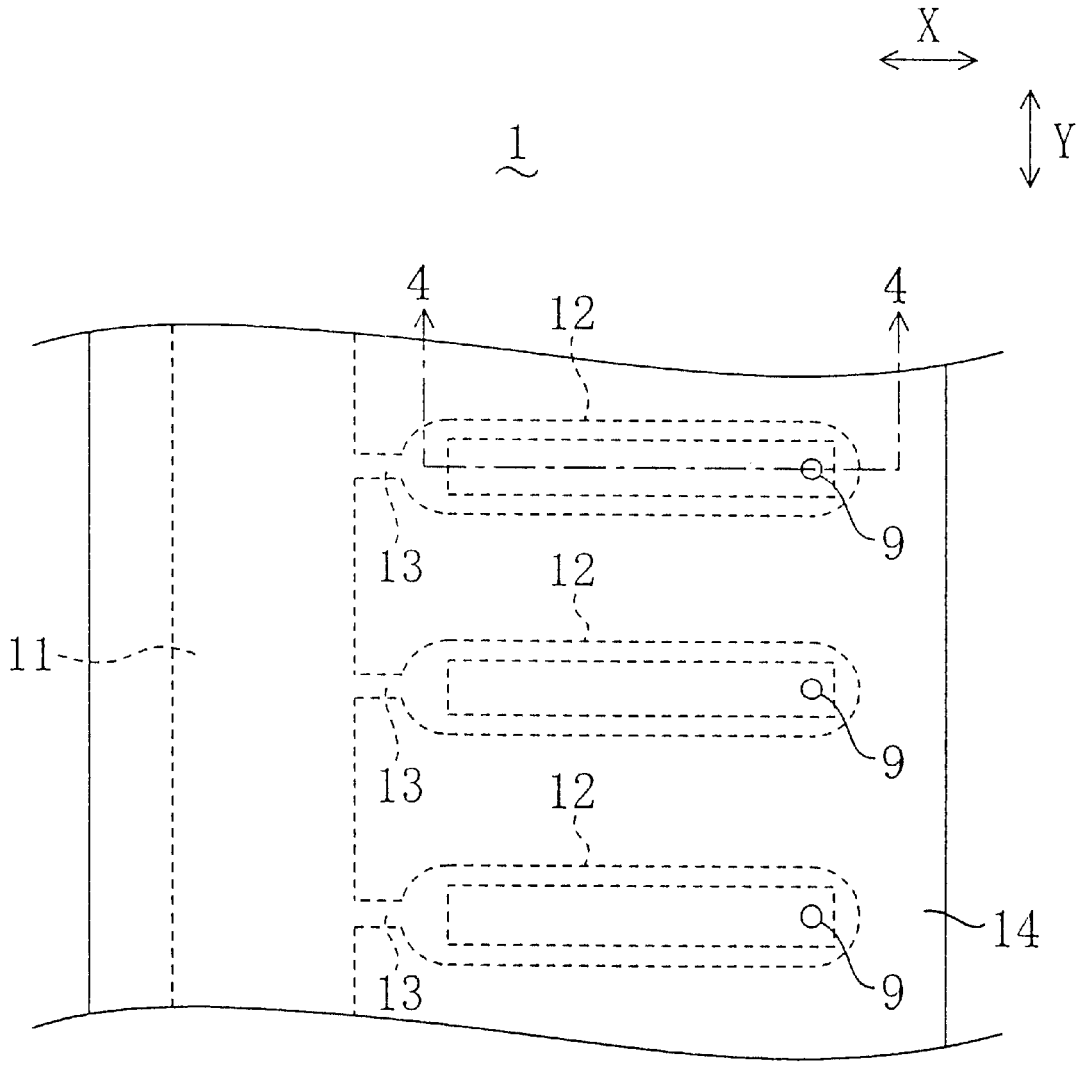
FIG. 2 is a front view partially showing a nozzle surface of an ink jet head.
Figure 3:
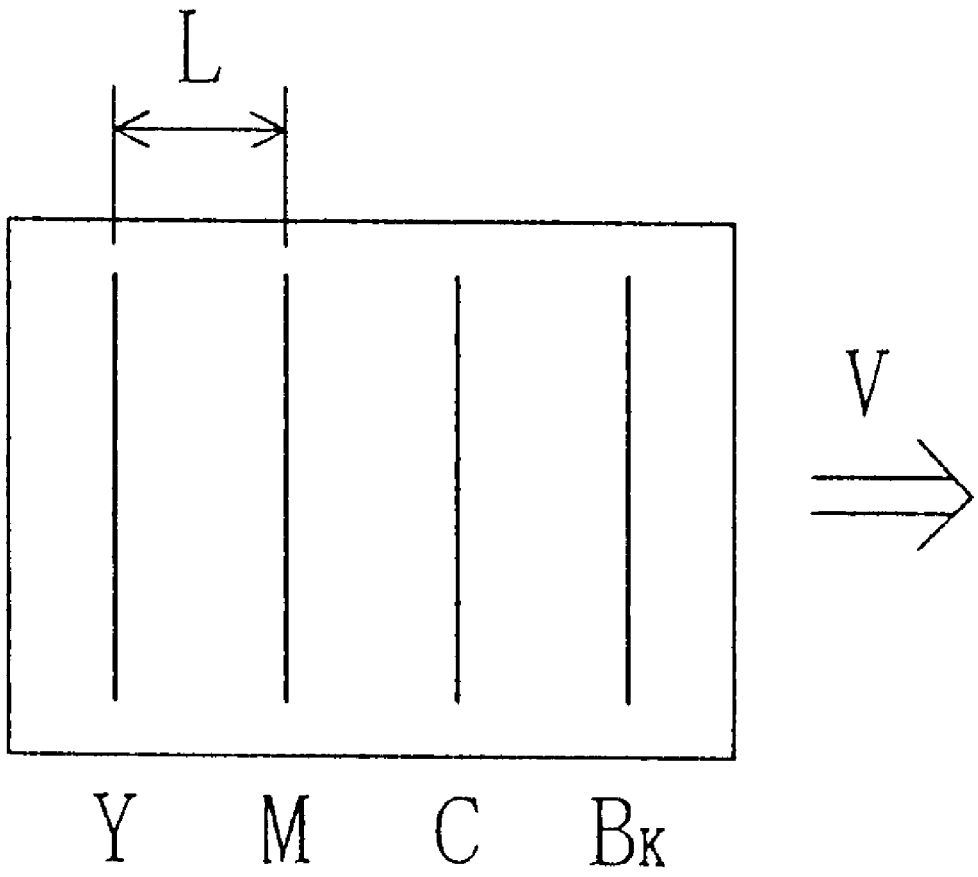
FIG. 3 is a front view of a nozzle surface, showing in a model form a nozzle row of the ink jet head.

FIG. 2 is a top view illustrating a part of a head surface of the ink jet head 1. The ink jet head 1 is provided with four heads for a total of 4 kinds of colors, namely a yellow head, a magenta head, a cyan head, and a black head. The respective heads emit ink of the respective colors. Referring to FIG. 2, there is shown a partial top view of a head that emits ink of one of the four colors. Each head has 300 nozzles 9 arranged at a given pitch of P (P=84.6 $\mu$m) in the secondary scanning direction, and the head density is set to a value of 300 dpi. As shown in model form in FIG. 3, the yellow head (Y), the magenta head (M), the cyan head (C), and the black head (Bk) are arranged in that order in the principal scanning direction. A structure may be employed in which each of the Y, M, C, and Bk heads is made up of two rows of nozzles arranged at a given pitch of 169.3 $\mu$m corresponding to a head density of 150 dpi.

Compartmented and formed within the ink jet head 1 are pressure chambers 12 for the respective nozzles 9. Each pressure chamber 12 is a long groove extending in the principal scanning direction and is arranged parallel with its adjoining pressure chamber 12. Each nozzle 9 is formed at the right-hand side edge of its associated pressure chamber 12. Compartmented and formed on the left-hand side of the pressure chambers 12 in the head 1 is an ink supplying chamber 11 extending in the secondary scanning direction. Ink supplying passages 13 are formed between the ink supplying chamber 11 and each of the pressure chambers 12. The ink supplying chamber 11 communicates with the pressure chambers 12 through the ink supplying passages 13.

Figure 4:
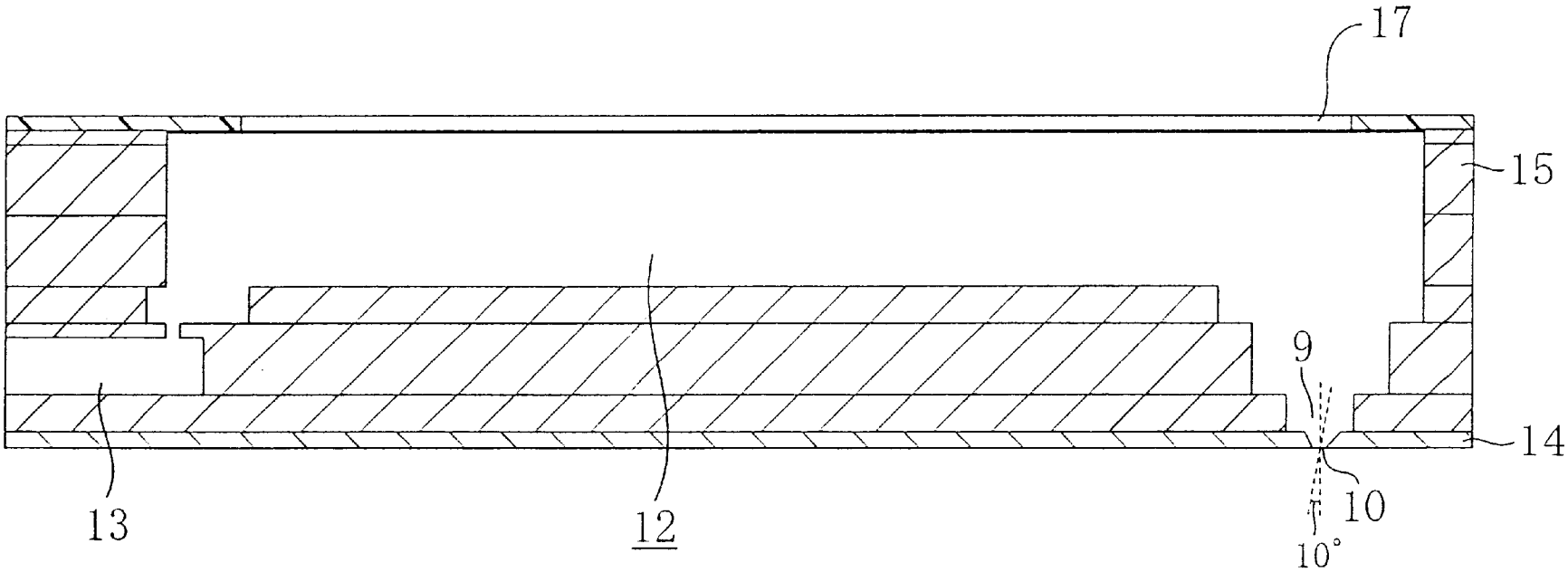
FIG. 4 is a cross-sectional view taken on line A—A of FIG. 2.
Figure 5:
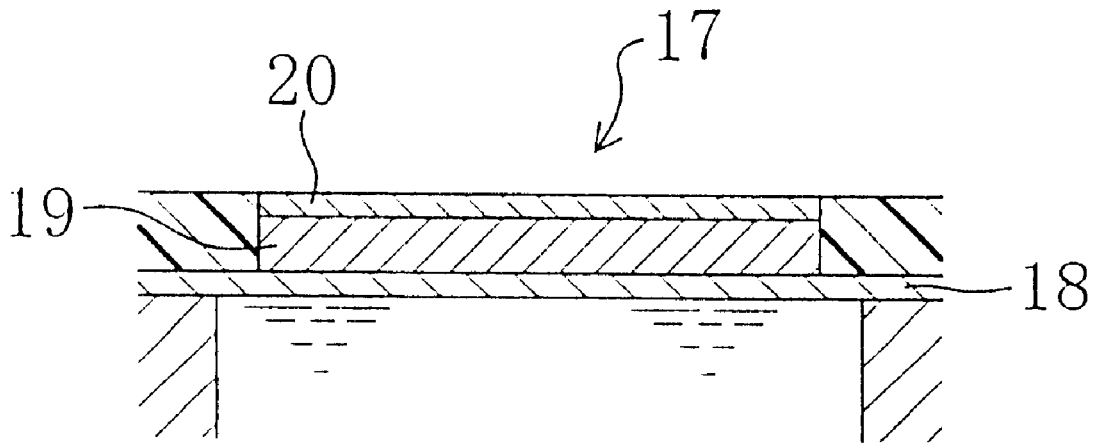
FIG. 5 is an enlarged cross-sectional view showing a vicinity of an actuator of the ink jet head.

As shown in FIG. 4, the ink jet head 1 is constructed by sequential lamination of a nozzle plate 14 in which a nozzle orifice 10 is formed, a dividing wall 15 for compartment-forming the pressure chamber 12 and the ink supplying passage 13, and an actuator 17. Whereas the nozzle plate 14 is formed of a stainless plate having a thickness of 20 $\mu$m, the dividing wall 15 is formed of a lamination of stainless plates having a thickness of 280 $\mu$m. As shown in FIG. 5 in an exaggeration manner, the actuator 17 is constructed by sequential lamination of an oscillating plate 18, a piezoelectric element 19, and an individual electrode 20. The oscillating plate 18 is formed of 2-$\mu$m chrome (Cr) and functions also as a common electrode for applying a voltage to the piezoelectric element 19 with the individual electrode 20. The piezoelectric element 19 is formed of 3-$\mu$m PZT (lead zirconate titanate). The individual electrode 20 is formed of 0.1-$\mu$m platinum (Pt). Water ink is held within each of the pressure chambers 12.

Figure 6:
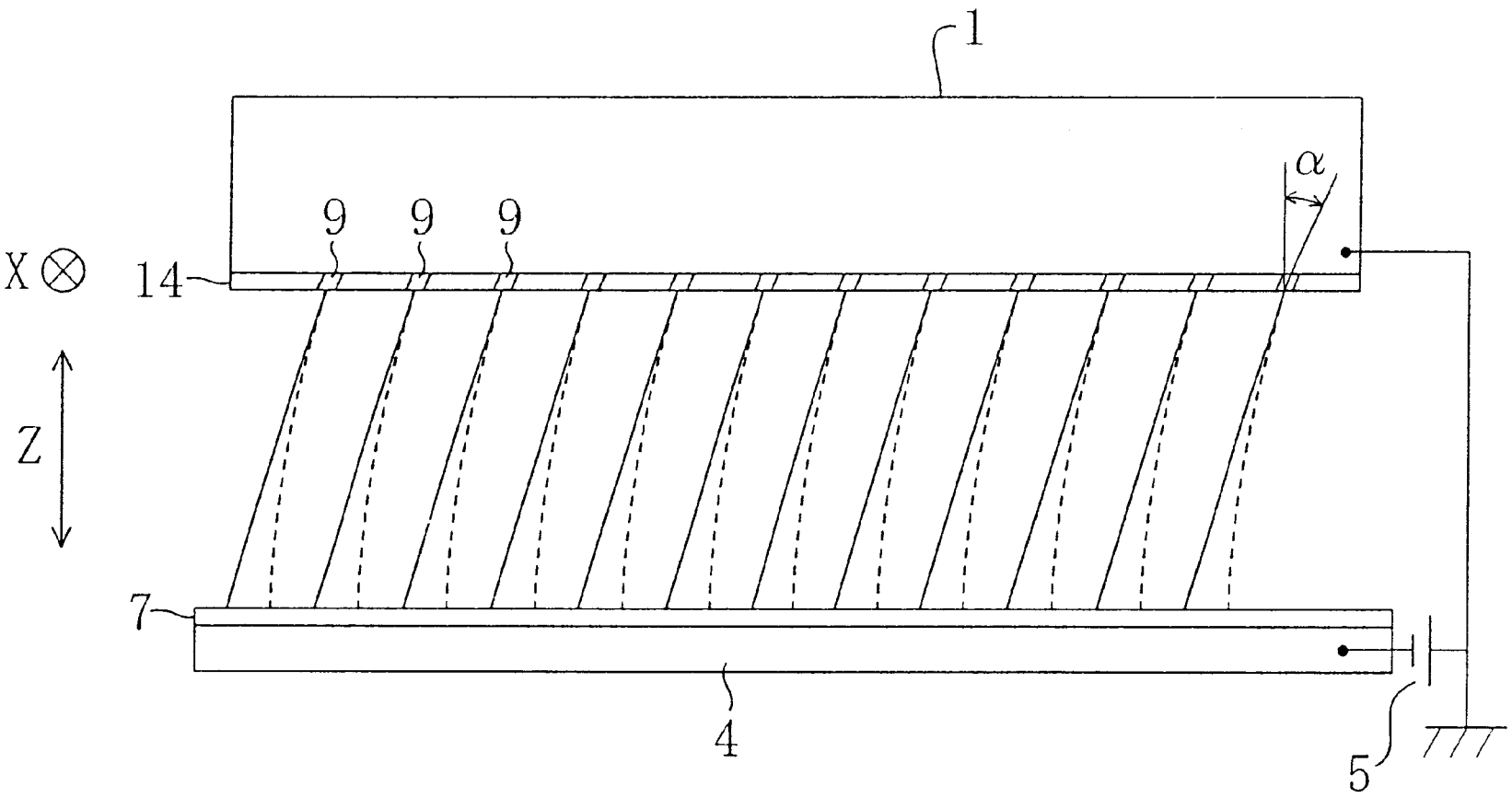
FIG. 6 is a cross-sectional view along the secondary scanning direction, showing in a model form the ink jet head and a facing electrode.
Figure 7:
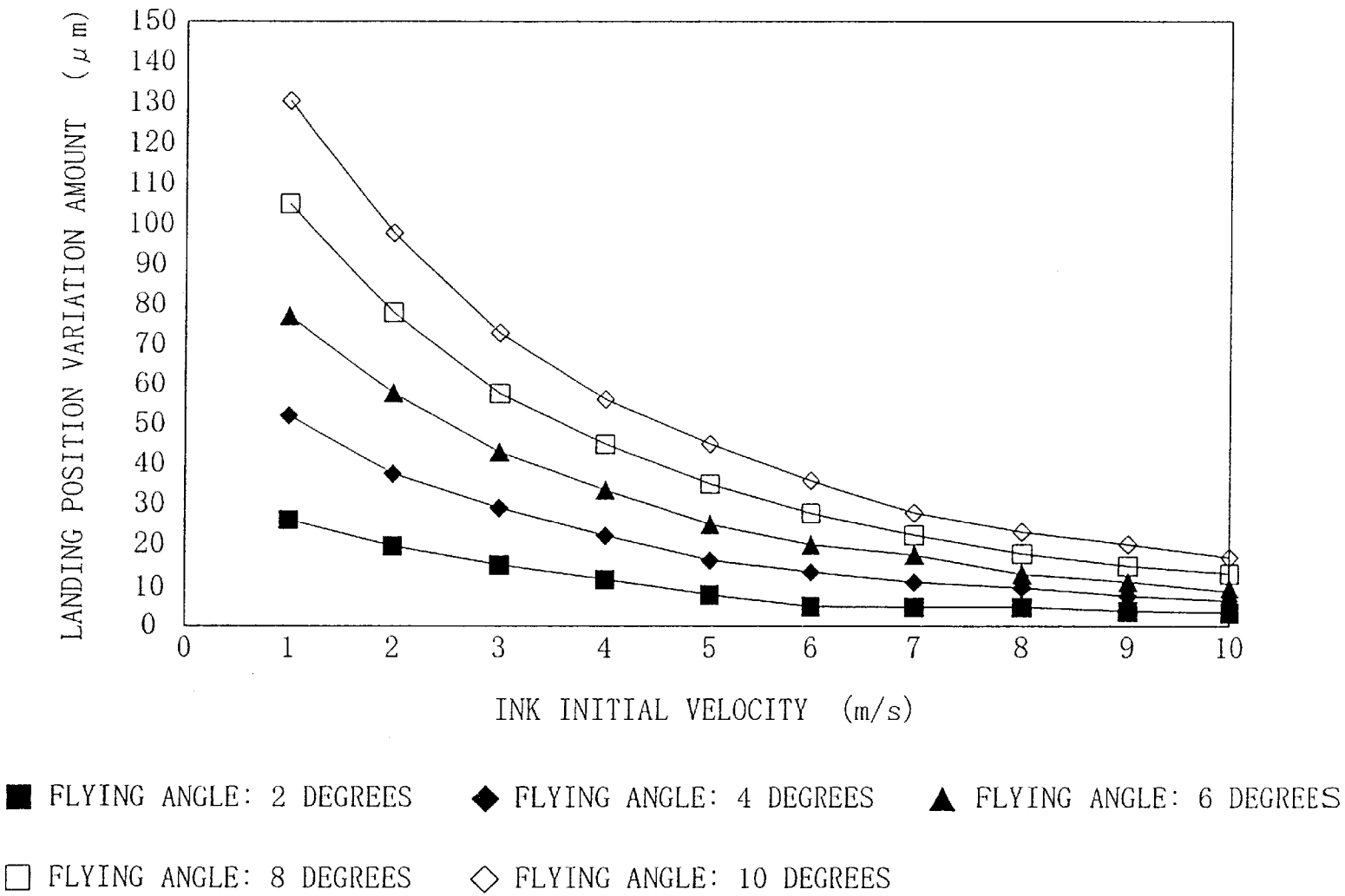
FIG. 7 graphically shows a relationship between the initial velocity of ink and the landing-position variation amount.

One of the features of the present invention is that each nozzle is opened in a direction non-parallel with a virtual plane formed by the principal scanning direction (X) and the direction of an electric field (Z). In the first embodiment, particularly, each nozzle 9 is opened along the secondary scanning direction Y in order that two droplets of ink emitted from the same nozzle during one print cycle can land at adjoining position in the second scanning direction Y. More specifically, as shown in FIG. 6, each nozzle is formed such that within a virtual plane normal to the principal scanning direction, an angle $\alpha$, which is formed by a perpendicular line extending from the nozzle orifice 10 down to the recording paper sheet 7 (i.e., a line in parallel with the electric field direction Z) and a direction in which the nozzle orifice 10 opens, is 10 degrees. It is needless to say that the angle a is not limited to the foregoing value (i.e., 10 degrees). The angle $\alpha$ can be set to various values on the basis of the specification of the ink jet head 1. For example, a setting of the angle $\alpha$ can be performed on the basis of the result of experiments or simulation, as shown in FIG. 7.

Figure 8:
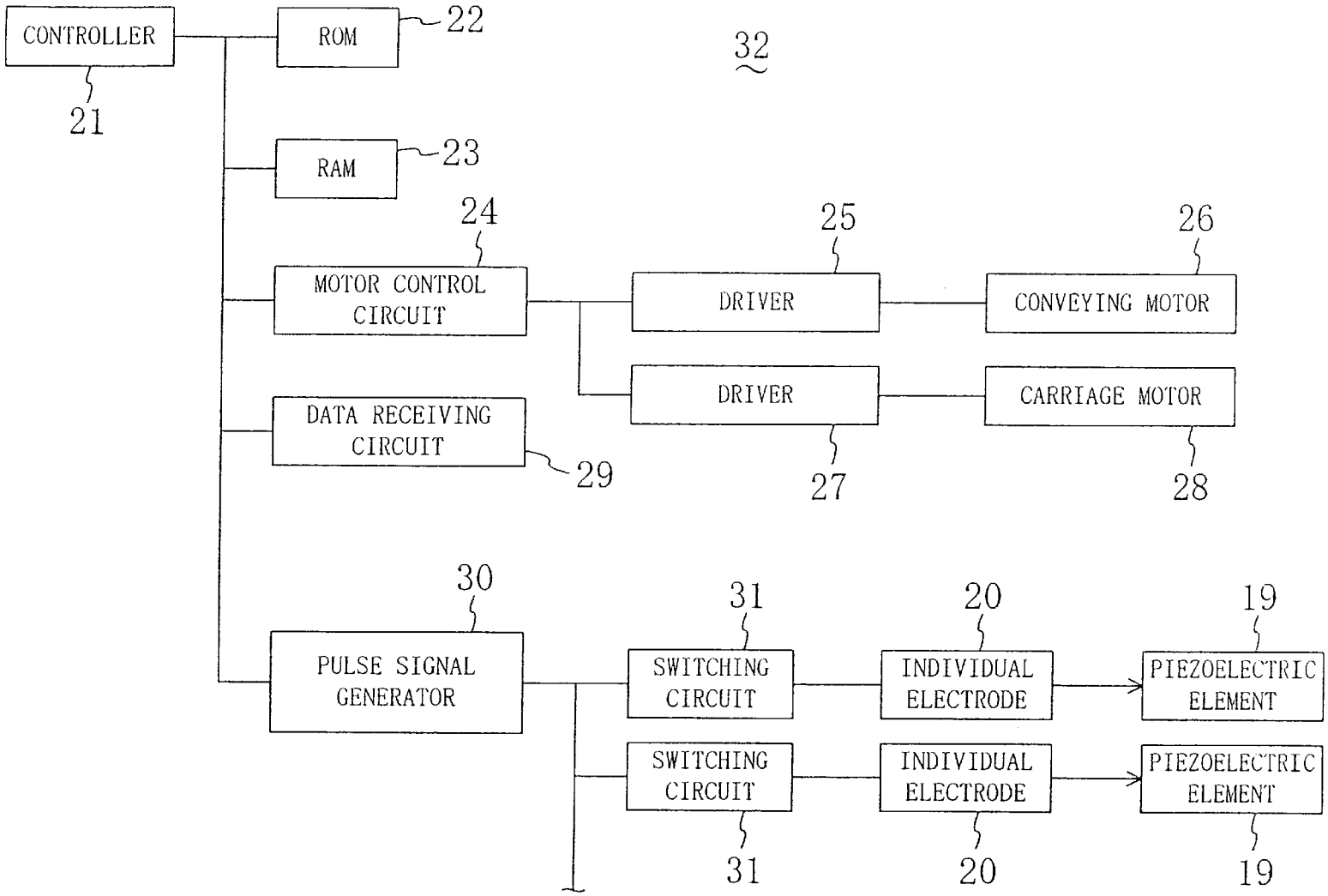
FIG. 8 is a block diagram showing a structure of a drive circuit.

As shown in FIG. 8, a drive circuit 32 of the ink jet head 1 includes a control section 21 formed by a CPU, a ROM 22 for the storage of process routines or the like for use in various data processing, a RAM 23 for, for example, the storage of various data, a motor controlling circuit 24 for driving a conveying motor 26 of the paper feeding roller 6 and a carriage motor 28, a data receiving circuit 29 for receiving print data, and a pulse signal generating circuit 30. A driver 25 is disposed between the motor controlling circuit 24 and the conveying motor 26. A driver 27 is disposed between the motor controlling circuit 24 and the carriage motor 28.

The pulse signal generating circuit 30 is a circuit for generating a voltage that is applied for periodically displacing the piezoelectric element 19. The individual electrodes 20 are connected via switch circuits 31 to the pulse signal generating circuit 30. Disposed between each switch circuit 31 and each individual electrode 20 are amplifying circuits not shown. The switch circuit 31 is a circuit for selectively outputting a pulse signal generated by the pulse signal generating circuit 30 to each individual electrode 20.

The pulse signal generating circuit 30 is constructed so as to generate a pulse signal at a frequency of 20 kHz, in other words, the pulse signal generating circuit 30 generates a pulse signal for every 50 $\mu$s. Such arrangement enables each of the nozzles 9 to emit two ink droplets during a print cycle of 100 $\mu$s. That is to say, the instant drive circuit 32 is constructed such that ink dots which are arranged next to each other in the principal scanning direction are formed for every 100 $\mu$s.

Operation of the Ink Jet Recording Apparatus

Referring to FIG. 1, the entire operation of the ink jet recording apparatus will be described below. The recording paper sheet 7 is first conveyed by the paper feeding roller 6 to a desired position. Thereafter, each of the nozzles 9 of the ink jet head 1 emits ink droplets while the carriage 2 is conveyed by a drive motor (not shown) from a position X1 to a position X2 along the principal scanning direction. As a result, a recording image for one scanning operation of the ink jet head 1 is recorded on the recording paper sheet 7. Subsequently, the recording paper sheet 7 is conveyed by the paper feeding roller 6 for a desired amount while the carriage 2 is returned from the position X2 to the position X1. Thereafter, each of the nozzles 9 is caused to emit ink droplets while the carriage 2 is again shifted from the position X1 to the position X2. As a result, a recording image for another one scanning operation is recorded on the recording paper sheet 7. Such an operation is repeatedly carried out for the realization of forming an image on the recording paper sheet 7.

Operation of Emitting Ink Droplets

Next, the operation of emitting droplets of ink from the nozzle 9 will be described. Upon application of a voltage to the piezoelectric element 19, the piezoelectric element 19, together with the oscillating plate 18, bends in a direction in which the pressure chamber 12 decreases in volume. This accordingly results in placing an ink in the pressure chamber 12 under higher pressure, thereby causing the ink to fly in the form of a droplet from the nozzle 9 towards the recording paper sheet 7.

At this time, when no voltage is applied between the nozzle plate 14 and the facing electrode 4, the nozzle 9 emits an ink droplet which is not electrified (i.e., an uncharged ink droplet). Such an uncharged ink droplet flies along the opening direction of the nozzle orifice 10 as indicated by a solid line of FIG. 6, and lands on a position on the recording paper sheet 7 which is on the extension of the nozzle orifice 10.

On the other hand, application of a voltage between the nozzle plate 14 and the facing electrode 4 induces a positive charge to an ink within the nozzle 9, whereby an ink droplet positively electrified (i.e., a charged ink droplet) is ejected from the nozzle 9. Additionally, an electric field is created between the nozzle plate 14 and the facing electrode 4, because of which the charged ink droplet will undergo a deflection by the created electric field as indicated by a broken line of FIG. 6, resulting in landing at a position different from the one where the aforesaid uncharged ink droplet landed.

Since an uncharged ink droplet is not accelerated by an electric field, it will fly at its initial velocity all the way. On the other hand, a charged ink droplet is accelerated by an electric field and therefore, its mean flying velocity becomes greater than the initial velocity. Accordingly, charged ink droplets have a shorter landing time (i.e., a period of time taken from emission to landing) in comparison with uncharged ones. Therefore, in the present embodiment, ink droplet emission is carried out such that uncharged ink droplets and charged ink droplets are emitted in that order. In other words, during a single print cycle in which first and second ink droplets are emitted, an uncharged ink droplet is emitted as the first ink droplet and a charged ink droplet is emitted as the second ink droplet. Such arrangement diminishes positional deviation in the principal scanning direction occurring between the first and second ink droplets due to the movement of the carriage 2.

The above will be described using an concrete example in which (i) the ink droplet initial velocity is 5 m/s, (ii) the voltage between the nozzle plate 14 and the facing electrode 4 is 2 kV, (iii) the clearance between the nozzle plate 14 and the facing electrode 4 is 1 mm, and the travelling speed of the carriage 2 is 416 mm/s. In this case, the charged ink droplet has a landing time of 152.2 $\mu$s, while the uncharged ink droplet has a landing time of 203.1 $\mu$s. Therefore, the difference in landing time between these charged and uncharged ink droplets is 203.1−152.2=50.8 $\mu$s. Accordingly, if an uncharged ink droplet is emitted after a charged ink droplet, then the amount of landing position deviation (misregistration) is (50.08+50.0) $\mu$s×416 m/s=42 $\mu$m. On the other hand, if a charged ink droplet is emitted after an uncharged ink droplet, then the amount of landing position deviation is (50.08–50.0) $\mu$s×416 m/s=0.3 $\mu$m. To sum up, the arrangement that emission of charged ink droplets follows that of uncharged ink droplets will diminish the degree of landing position deviation in the principal scanning direction.

Deflection Control

Figure 9:
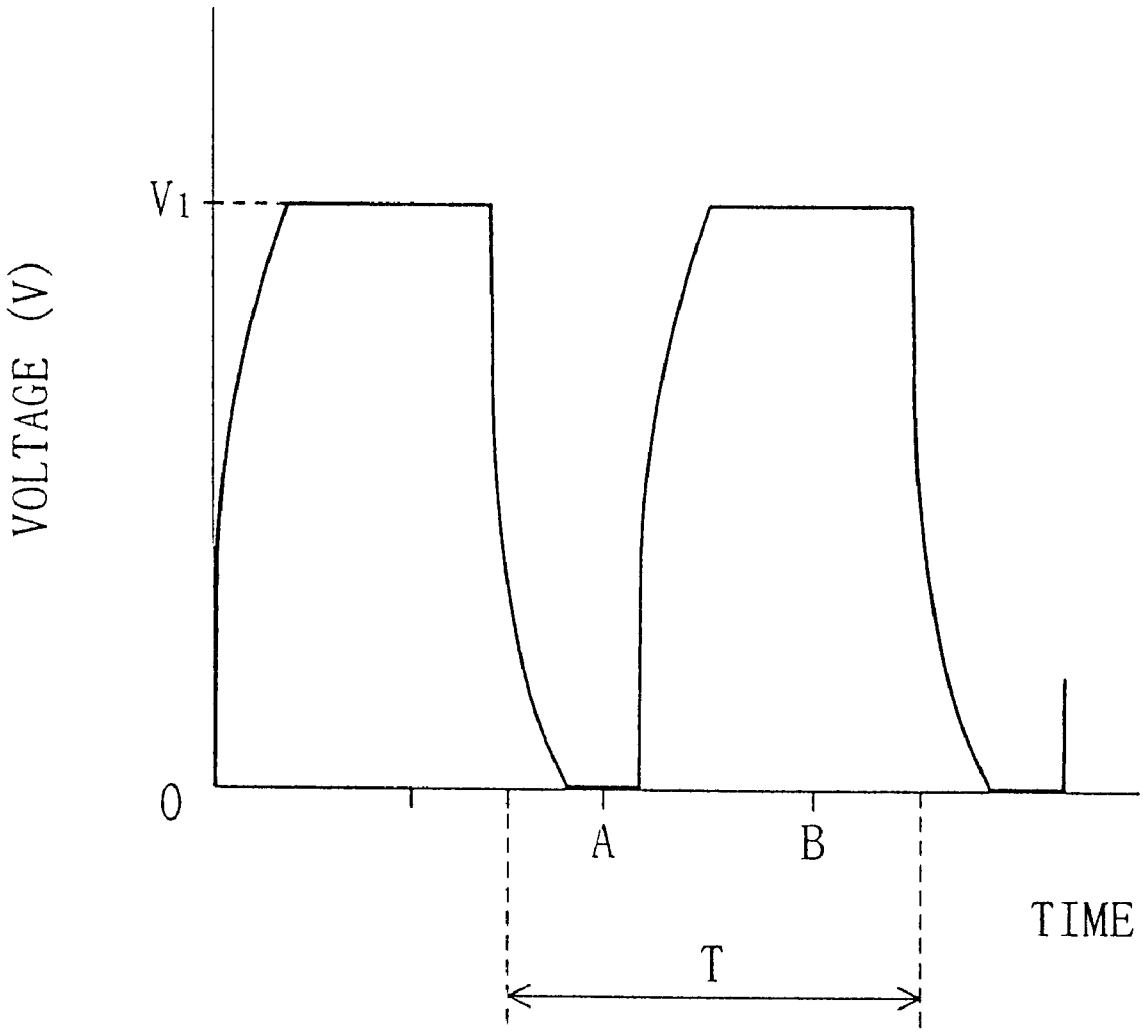
FIG. 9 is an applied-voltage waveform diagram.

As shown in FIG. 9, the power supply 5 performs ON/OFF control for each print cycle of T. In the present embodiment, the power supply 5 is set such that switching between the state of ON and the state of OFF occurs in that order, for causing an uncharged ink droplet and a charged ink droplet to be emitted in that order.

As described above, each of the nozzles 9 emits a first and a second ink droplet during one print cycle. More specifically, the first ink droplet is emitted when the power supply 5 is in the state of OFF. On the other hand, the second ink droplet is emitted when the power supply 5 is in the state of ON. The second ink droplet is emitted after an elapse of T/2 from the time the first ink droplet was emitted. In other words, each ink droplet is emitted for every T/2 cycle. Here, since the print cycle is set to a value of 50 $\mu$s, each ink droplet is emitted for every 25 $\mu$s.

The emission velocity, at which each ink droplet is emitted, is set such that the landing positions of the first and second ink droplets are arranged side by side at intervals of ½ of the nozzle pitch P in the secondary scanning direction. Here, since the nozzles are formed at a pitch of 84.6 $\mu$m (density: 300 dpi), the landing positions of ink droplets are set to be arranged side by side at 42.3-$\mu$m intervals. In the present embodiment, the emission velocity of each of the first and second ink droplets is set to a value of 5 m/s in order that the first and second ink droplets can be arranged at intervals of the aforesaid value. The emission velocity can be set easily by controlling, for example, a voltage that is applied to the piezoelectric element 19.

Figure 10:
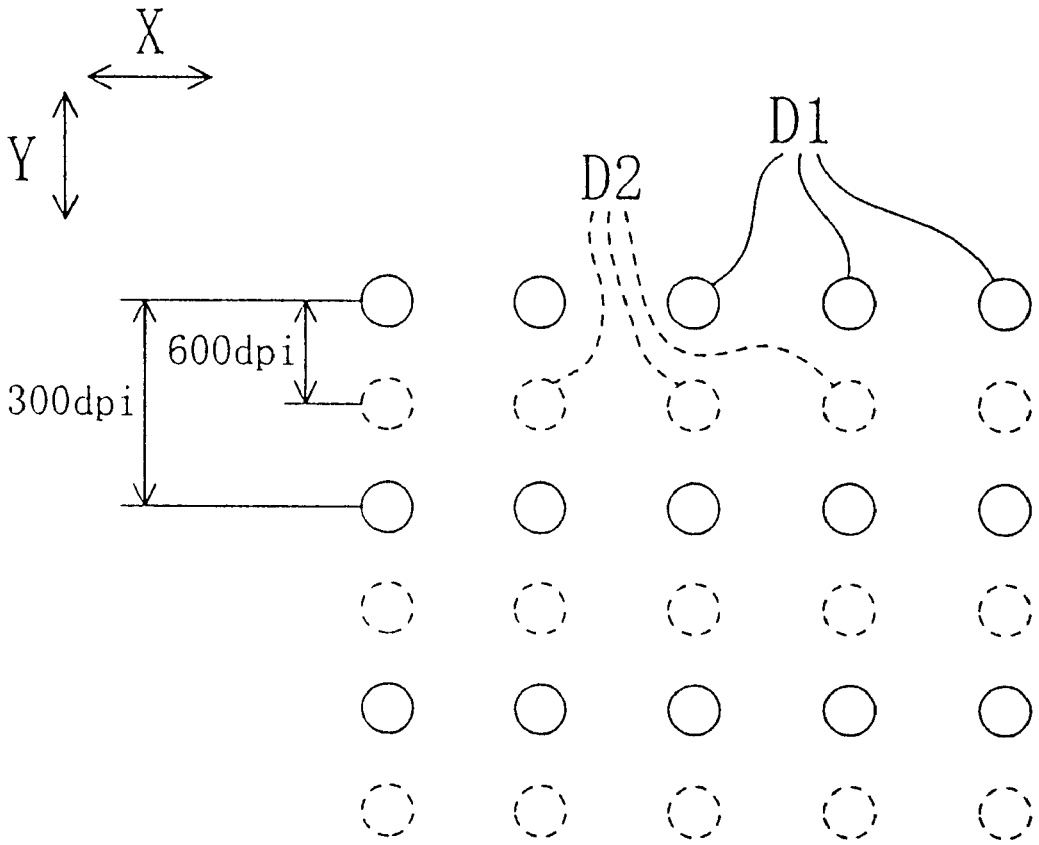
FIG. 10 is a diagram showing a dot pattern.

Accordingly, in the first embodiment, first and second ink dots D1 and D2 each are formed on the recording paper sheet 7 at a density of 600 dpi, as shown in FIG. 10. That is to say, a second dot D2 formed by landing of a second ink droplet (indicated by broken-line circle) is sandwiched between each first dot D1 formed by landing of a first ink droplet (indicated by solid-line circle), thereby making it possible to provide an improved dot density twice the conventional dot density. As a result, despite the nozzle density of 300 dpi, the dot density is 600 dpi.

Effects of the First Embodiment

As described above, in accordance with the present embodiment, it is designed such that each of the nozzles 9 emits two ink droplets, i.e., a first and a second ink droplet, during one print cycle. In addition, one of the first and second ink droplets is subjected to deflection, which makes it possible to cause the first and second ink droplets to land on the recording paper sheet 7 in a side by side fashion in the secondary scanning direction. As a result of such arrangement, it becomes possible to provide an improved dot density greater than the nozzle density. Accordingly, it becomes possible to provide a rapidly improved dot density thereby making it possible to perform high-quality recording.

Additionally, ink droplet deflection can be accomplished easily by electrifying ink droplets and by creating an electric field between the nozzle plate 14 and the facing electrode 4, therefore making it possible to easily and inexpensively provide a means for the deflection of ink droplets. Further, it is possible to easily control an ink-droplet deflection amount by controlling the voltage between the nozzle plate 14 and the facing electrode 4.

It is arranged such that a charged ink droplet is emitted after emission of an uncharged ink droplet, which makes it possible to make the landing time of the ink droplet emitted in the second place shorter than that of the ink droplet emitted in the first place. Because of this, it becomes possible to diminish the landing position deviation (misregistration) in the principal scanning direction of these ink droplets accompanied with the movement of the carriage 2.

Variation Example 1

In the first embodiment describe above, it is arranged such that two different ink droplets, of which one is a charged ink droplet and the other is an uncharged ink droplet, are emitted during one print cycle. However, the number of ink droplets to be emitted during one print cycle is not limited to two (2). Three or more ink droplets may be emitted during one print cycle, in which case a plurality of charged ink droplets are to be emitted during one print cycle and the charge amount of each of the charged ink droplets or the applied voltage is set to a plurality of levels. Because of such arrangement, these charged ink droplets differ in the amount of deflection from each other, so that the amount of landing point deviation of each of the charged ink droplets is varied. Accordingly, it becomes possible to increase the dot density more than three times as large as the nozzle density.

Variation Example 2

Figure 11:
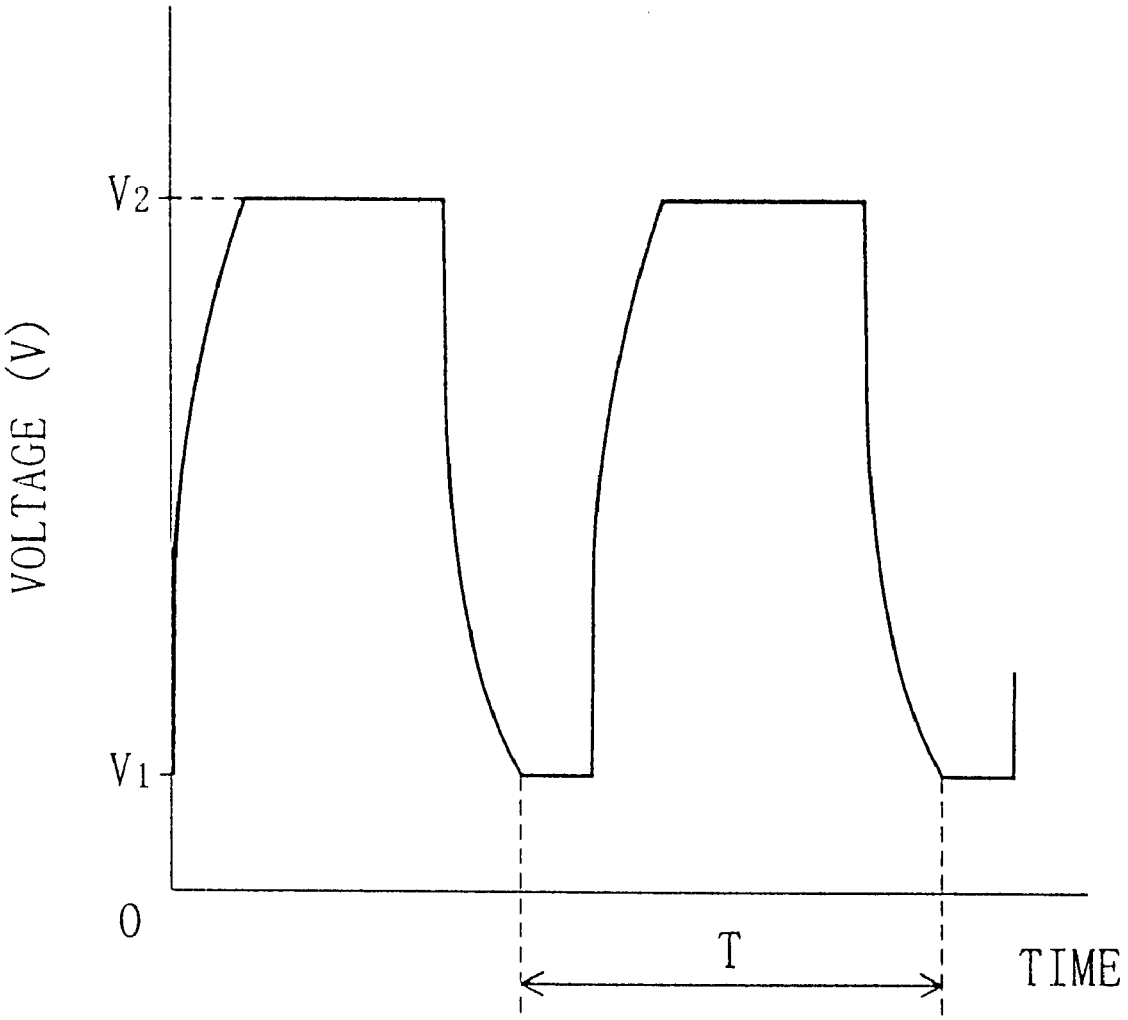
FIG. 11 is an applied-voltage waveform diagram.

Further, in the first embodiment, the power supply 5 is on/off controlled such that the landing positions of the first and second ink droplets are deviated. Such control for the deviation of the landing positions of the first and second ink droplets should not be considered restrictive. For example, as shown in FIG. 11, there may be made a change in ink-droplet landing position by the use of voltage switching control for alternately switching between a first plus voltage V1 and a second plus voltage V2 greater than the first plus voltage V1. In such case, both the first and second ink droplets are subject to deflection; however, the landing positions of the first and second ink droplets are deviated by a given pitch in the secondary scanning direction because the second ink droplet undergoes a greater deflection than the first ink droplet. The ratio of the first plus voltage V1 to the second plus voltage V2 can be set to any values as long as the landing positions of the first and second ink droplets are deviated by a given amount. It is preferably desired that the ratio is 1:5 or above.

Embodiment 2

With a view to preventing the occurrence of so-called white striping, in a second embodiment of the invention there is made modification to the on/off control of the power supply 5 of the first embodiment.

Figure 12:
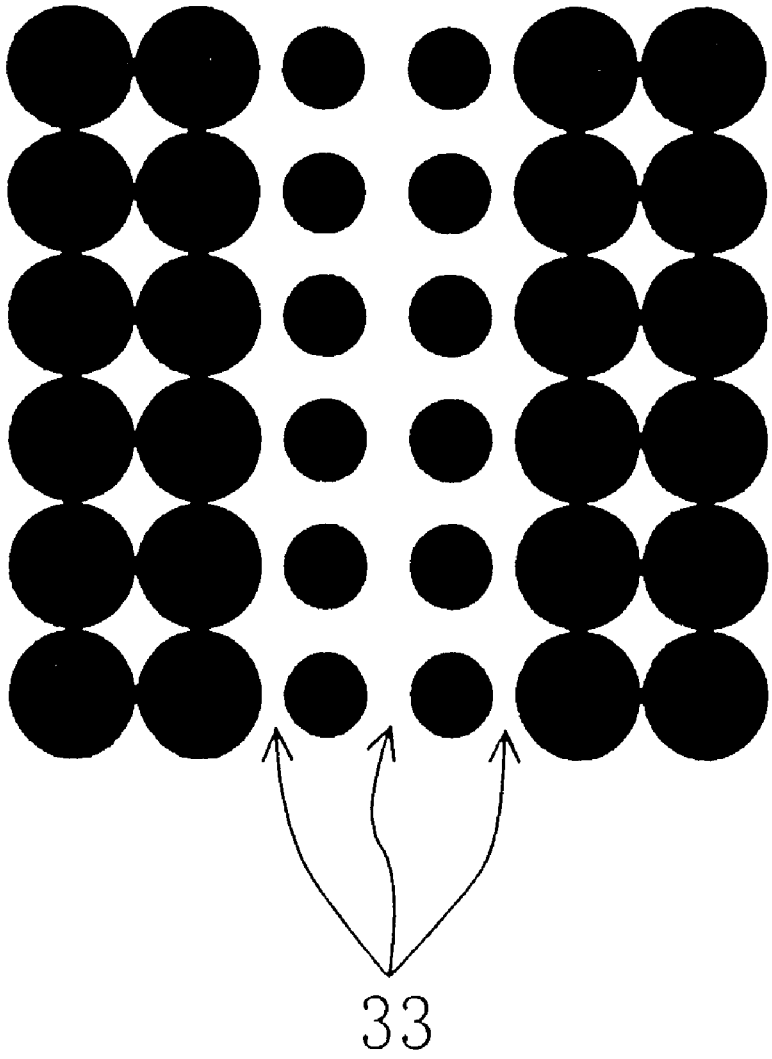
FIG. 12 is a pattern diagram for describing a white stripe.

Ink jet recording apparatus have some problems. For example, some of plural nozzles fail to emit an ink droplet of a predetermined diameter and the emission direction of ink droplets is deviated because the nozzle orifice 10 becomes clogged or because the piezoelectric element 19 deteriorates in quality. In such cases, as shown in FIG. 12, there is produced an unintentional spacing between dots. These spacings, when arranged in series in the principal scanning direction, result in the occurrence of a white stripe 33. If a great number of such white stripes 33 occur, this causes the quality of printing characters or images to deteriorate. Particularly, in the present ink jet recording apparatus, it is arranged such that two ink droplets are emitted from the same nozzle, which means that there is produced a series of white stripes 33 in the secondary scanning direction. Therefore, how to cope with the occurrence of white striping becomes important.

Figure 13:
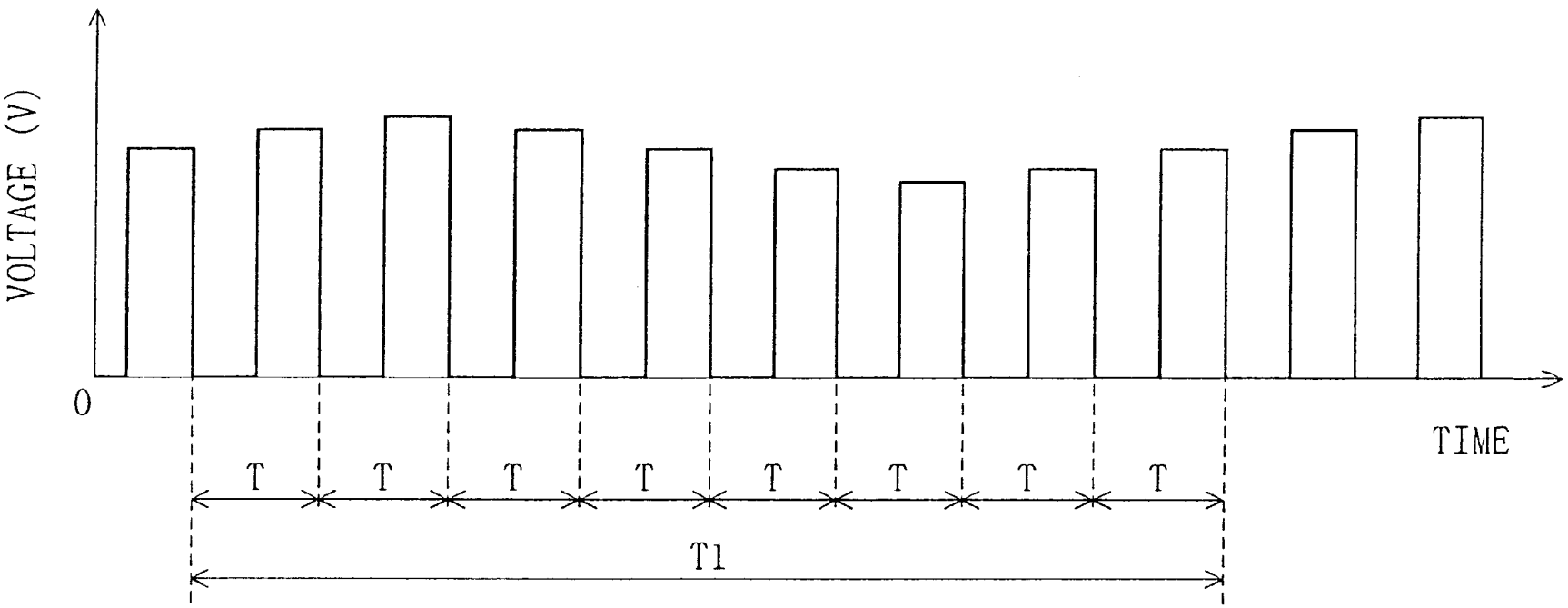
FIG. 13 is an applied-voltage waveform diagram.

Accordingly, a measurement is taken in the second embodiment. More specifically, a voltage, which is applied between the nozzle plate 14 and the facing electrode 4, is controlled in such a way as to periodically vary over a plurality of print cycles (over eight print cycles in the present embodiment), as shown in FIG. 13. If the traveling velocity of the carriage 2 is v and the interval between nozzle rows of different colors is L (see FIG. 3), the voltage is made to vary at a cycle of $T1=L/v\times N$, the number N being a natural number.

Figure 14:
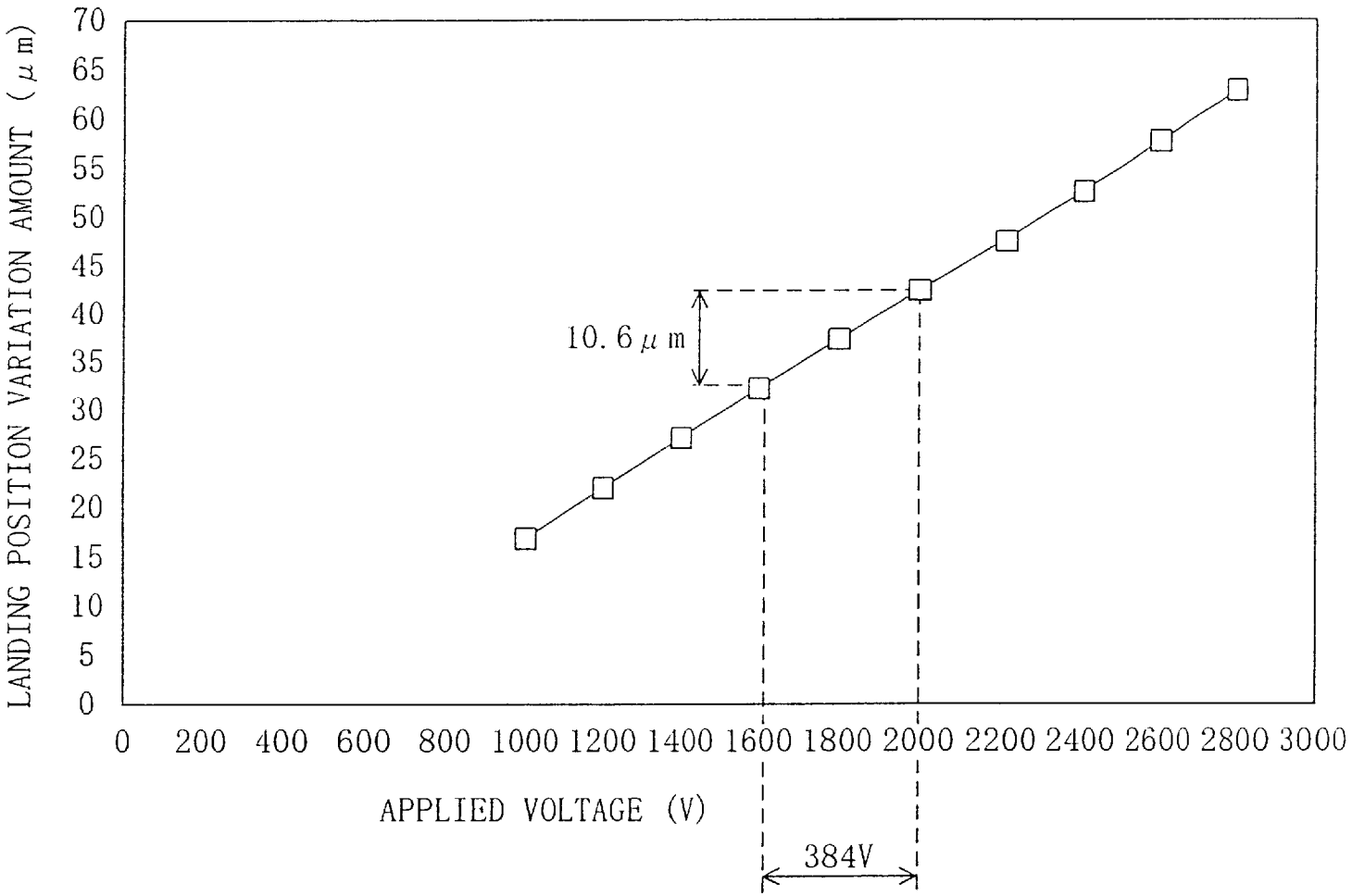
FIG. 14 graphically shows a relationship between the applied voltage and the landing-position variation amount.

Here, the voltage is made to vary, so that the amount of landing position deviation by voltage variation is ¼ of a length (i.e., 10.6 $\mu$m) corresponding to a density of 600 dpi. More specifically, it is required that the applied voltage be varied by 384 V for achieving a landing position deviation of 10.6 $\mu$m, as shown in FIG. 14. Therefore, it is arranged in the present embodiment such that the applied voltage is made to periodically vary in a range of 2 kV±192 V.

Accordingly, in the second embodiment, the landing position of charged ink droplets varies with the variation in applied voltage, which makes it possible to reduce the occurrence of the white stripe 33. The quality of recording characters, images, or the like becomes stable.

Additionally, since the voltage varies at a cycle of $v/L\times N$, the landing positions of ink droplets of colors of yellow (Y), magenta (M), cyan (C), and black (B) will vary in synchronization with one another. Accordingly, although the landing positions of ink droplets of these four colors vary, the relative positional relationship between dots of different colors remains unchanged. This positively ensures that color deviation caused by an overlapping of unintentional dots is prevented.

The landing position of ink droplets can arbitrarily be adjusted by performing control of the applied voltage. For example, based on the relationship of FIG. 14, adjustment of the applied voltage can be made such that the landing position deviation amounts to a predetermined value.

Variation Example 1

Figure 15:
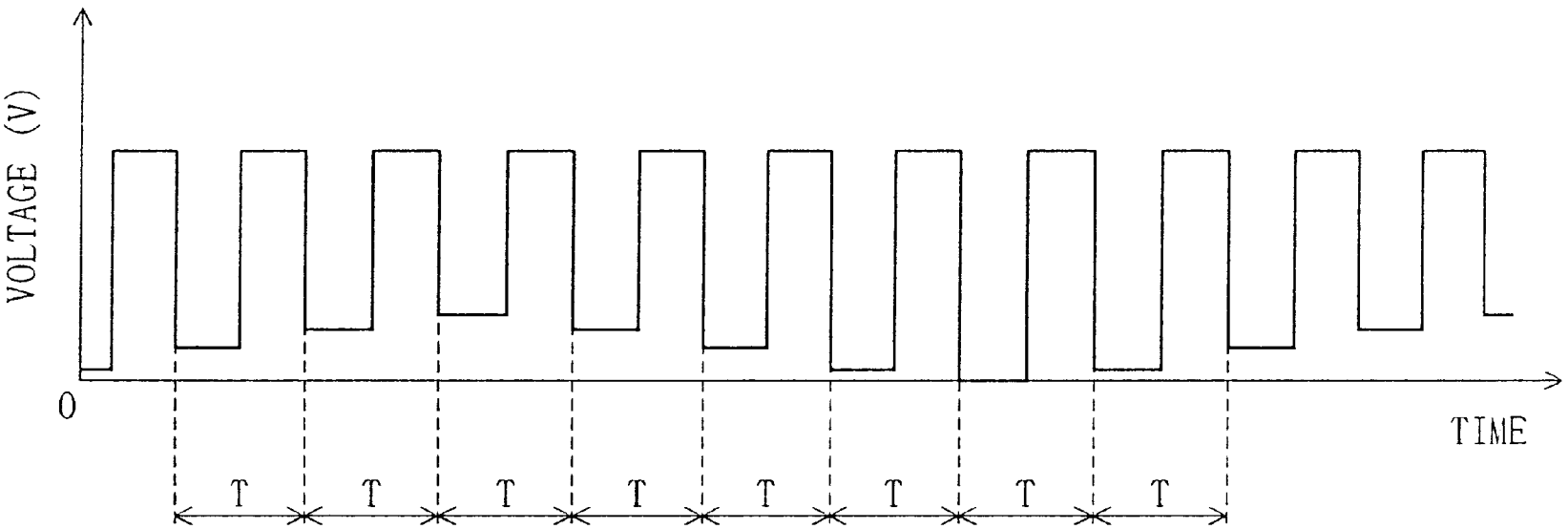
FIG. 15 is an applied-voltage waveform diagram.

As shown in FIG. 15, voltage variation control for the prevention of the occurrence of white striping is, needless to say, applicable to the second variation example of the first embodiment. In the second variation example of the first embodiment, the landing positions of ink droplets are varied using the first and second plus voltages. As a result of such arrangement, it becomes possible to apply voltage variation control to both of the first and second plus voltages. However, as shown in FIG. 15, it is preferred to apply such voltage variation control to the first plus voltage relatively lower in voltage value than the second plus voltage. The reason is that since a charged ink droplet (to which a smaller voltage is applied) is much affected by voltage variation in comparison with a charged ink droplet (to which is a greater voltage is applied), the amount of voltage variation necessary for securing a predetermined amount of deviation can be reduced, as shown in FIG. 16.

Figure 16:
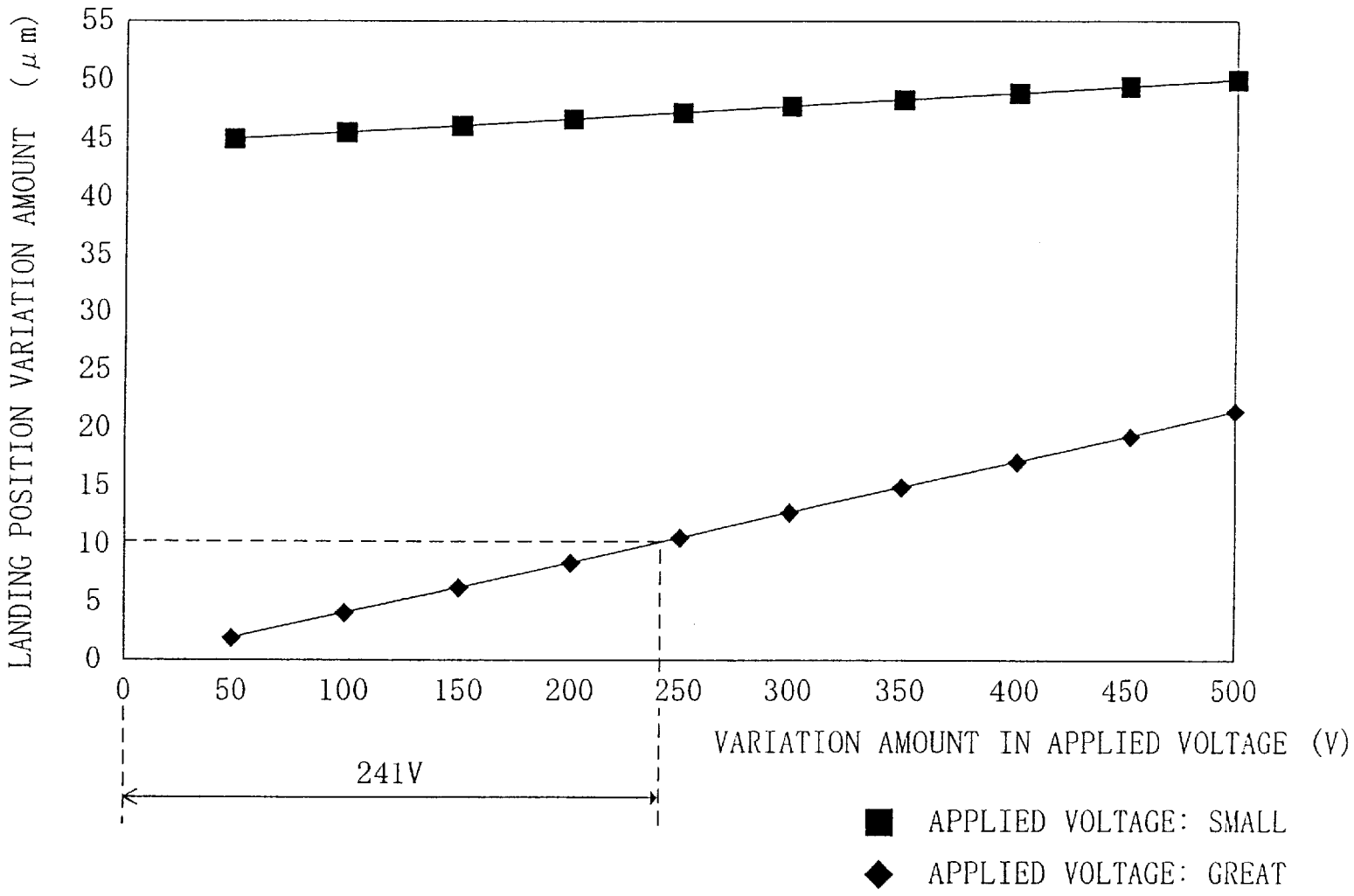
FIG. 16 graphically shows a relationship between the applied-voltage variation amount and the landing-position variation amount.

For example, assume now that the amount of variation in the ink-droplet landing position is, as shown in FIG. 16, 10.6 $\mu$m. As described in the second embodiment, when the second plus voltage (the greater one) is subjected to variation, a variation range of 384 V is required. On the other hand, when the first plus voltage (the smaller one) is subjected to variation, a variation range of 241 V suffices. Accordingly, voltage variation control can be carried out in a simple and easy manner.

Voltage variation control can, needless to say, be applied to both of the first and second plus voltages.

Embodiment 3

In a third embodiment of the invention, while the voltage applied between the nozzle plate 14 and the individual electrode 20 is maintained uniform, the nozzle 9 emits first and second ink droplets at different emission velocities.

An ink jet recording apparatus of the present embodiment is identical in structure with that of the first embodiment, and the description thereof is omitted here.

Control of the Emission Velocity of Ink Droplet

The controlling of the emission velocity of ink droplets can be carried out by adjustment of the displacement velocity of the oscillating plate 18. Adjustment of the displacement velocity of the oscillating plate 18 is performed by adjustment of the waveform of a voltage which is applied to the piezoelectric element 19.

Figure 17:
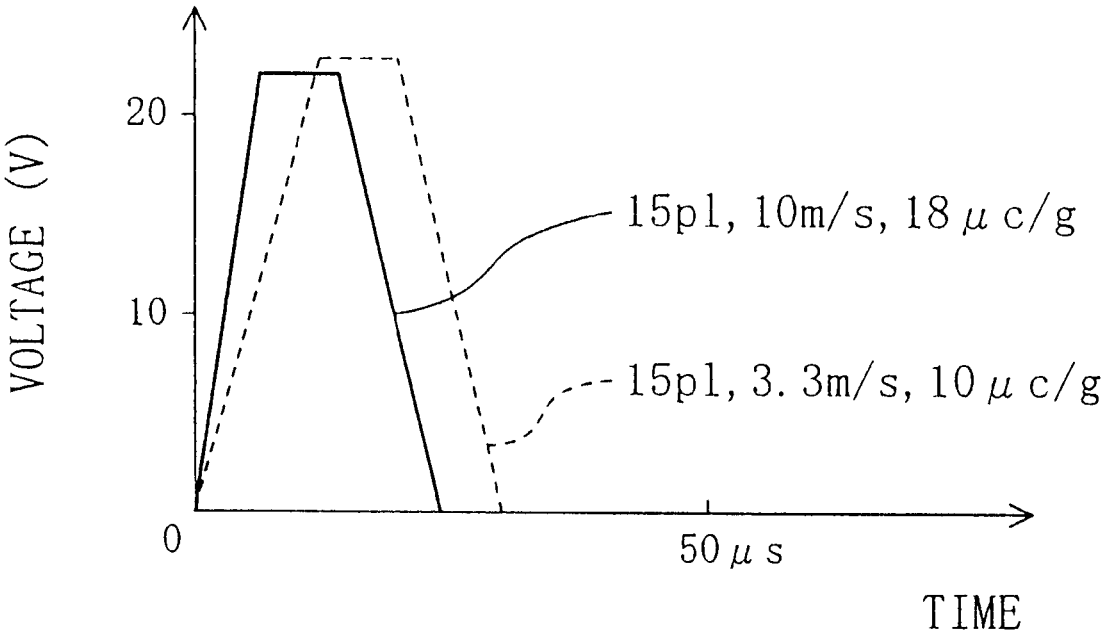
FIG. 17 is an applied-voltage waveform diagram.

For example, as is illustrated in FIG. 17, by adjusting the inclination angle of a rising part of a pulse voltage waveform applied to the piezoelectric element 19, it becomes possible to emit two ink droplets at the same emission volume, but at different emission velocities.

Relationship Between Velocity and Deflection

Figure 18A:
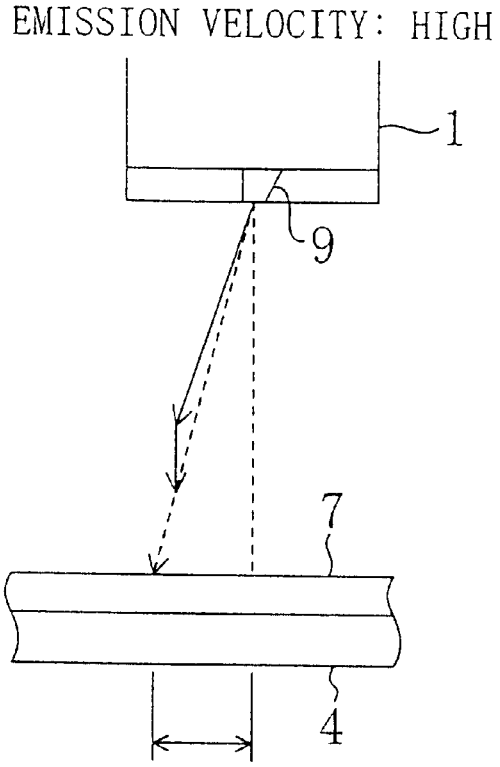
FIG. 18, comprised of FIGS. 18A and 18B, shows relationships between the emission velocity and the landing-position variation amount.
Figure 18B:
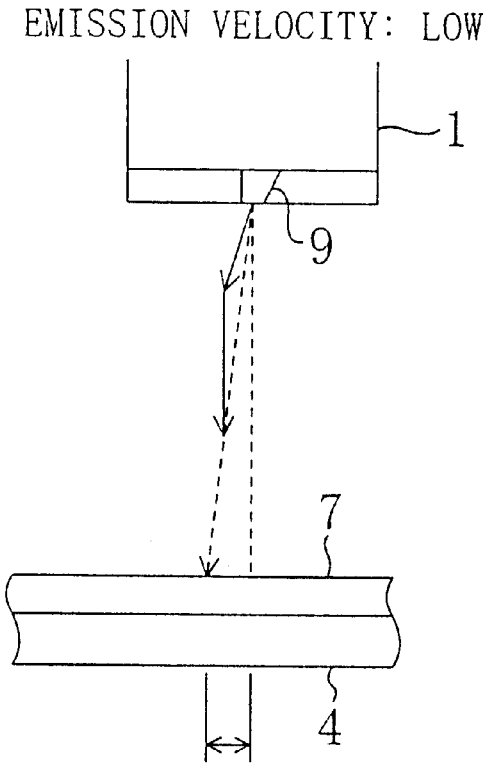

When emission velocity is great as shown in FIG. 18A, landing time is relatively short. Therefore, the degree of acceleration by an electric field is small and the component of velocity in the secondary scanning direction is great. Accordingly, the resulting landing position is much deviated from a point directly under the nozzle orifice 10. On the other hand, when emission velocity is small as shown in FIG. 18B, landing time is relatively long. As a result, the degree of acceleration by an electric field is great and the component of velocity in the secondary scanning direction becomes relatively small. Accordingly, the amount of landing position deviation from a point directly under the nozzle orifice 10 becomes relatively small. A first ink droplet (which is emitted at a lower emission velocity) and a second ink droplet (which is emitted at a higher emission velocity) are emitted during one print cycle, thereby making it possible to form two dots in the secondary scanning direction during a single print cycle.

Deflection Control

In accordance with the third embodiment, during one print cycle of T, a first ink droplet of a lower emission velocity is emitted and thereafter, a second ink droplet of a high emission velocity is emitted. Each ink droplet is emitted at intervals of T/2, as in the first embodiment.

Effects of the Third Embodiment

As a result of arrangement described above, the third embodiment also provides the same effects that the first embodiment does. Additionally, it is designed such that a second ink droplet of a higher emission velocity is emitted after a first ink droplet of a lower emission velocity, which makes it possible to diminish landing position deviation in the principal scanning direction accompanied with the movement of the carriage 2.

Variation Example

The number of ink droplets which are to be emitted during one print cycle is not limited to two (2). An arrangement may be employed in which three or more ink droplets of different emission velocities are emitted during one print cycle.

In order to prevent the occurrence of white striping, it may be arranged such that the emission velocity of at least one of the first and second ink droplets is varied over a plurality of print cycles.

Embodiment 4

In a fourth embodiment of the invention, first, second, and third ink droplets are emitted during one print cycle, wherein the landing positions of the first and second ink droplets become collected at the same point thereby to form a first dot, while the third ink droplet forms a second dot.

In accordance with the foregoing third embodiment, two ink droplets are emitted at the same emission volume, but at different emission velocities. Generally, it is easier to emit two ink droplets at different emission volumes and at different emission velocities than emitting two ink droplets at the same emission volume, but at different emission velocities. Therefore, in the fourth embodiment the following control is performed in order to facilitate the controlling of pulse voltages.

Figure 19:
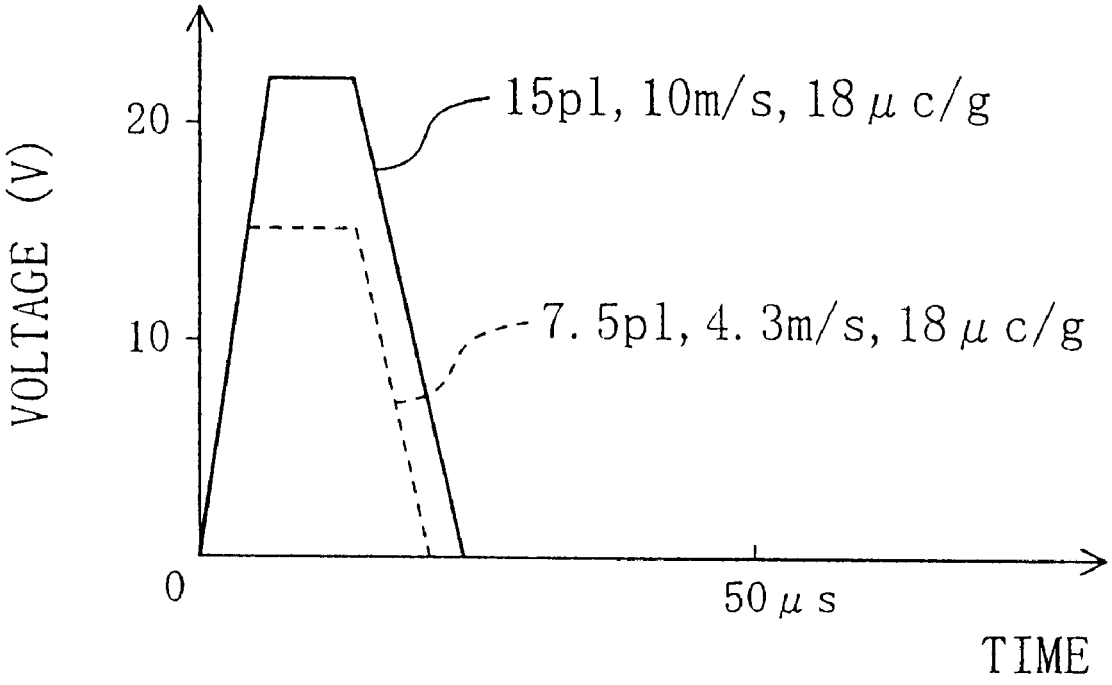
FIG. 19 is an applied-voltage waveform diagram.

That is, in accordance with the fourth embodiment, two pulse waveforms almost similar to each other in shape are employed, as shown in FIG. 19. More specifically, first and second ink droplets are emitted in succession at an emission volume of 7.5 pl and at an emission velocity of 4.3 m/s. Thereafter, after an elapse of T/2, a third ink droplet is emitted at an emission volume of 15 pl and at an emission velocity of 10 m/s.

As a result of such arrangement, the first and second ink droplets land on the same position on the recording paper sheet 7 in an overlapping fashion to form a single dot (i.e., a first dot). On the other hand, the third ink droplet independently forms a second dot. Here, the third ink droplet undergoes a less deflection than the first and second ink droplets because of its higher emission velocity. Accordingly, the first dot and the second are arranged side by side along the secondary scanning direction, therefore providing an improved dot density.

As described above, in accordance with the fourth embodiment, there is no need to emit ink droplets, which are to be emitted at different emission volumes, at the same emission velocity, thereby making it possible to easily and correctly generate a voltage pulse which is applied to the piezoelectric element 19.

Embodiment 5

In a fifth embodiment of the invention, first and second ink droplets are emitted through the nozzle 9, having different charge amounts.

An ink jet recording apparatus of the present embodiment is identical in structure with that of the first embodiment, and the description thereof will be omitted accordingly.

Control of the Ink Droplet Charge Amount

The charge amount of ink droplet can be controlled by adjustment of the displacement velocity of the oscillating plate 18. The displacement velocity of the oscillating plate 18 is adjusted by adjustment of the waveform of a voltage which is applied to the piezoelectric element 19.

For example, as is illustrated in FIG. 17, by adjusting the inclination angle of a rising part of a pulse voltage waveform applied to the piezoelectric element 19, it becomes possible to emit two ink droplets at the same emission volume, but at different charge amounts.

Relationship Between Charge and Deflection

Figure 20A:
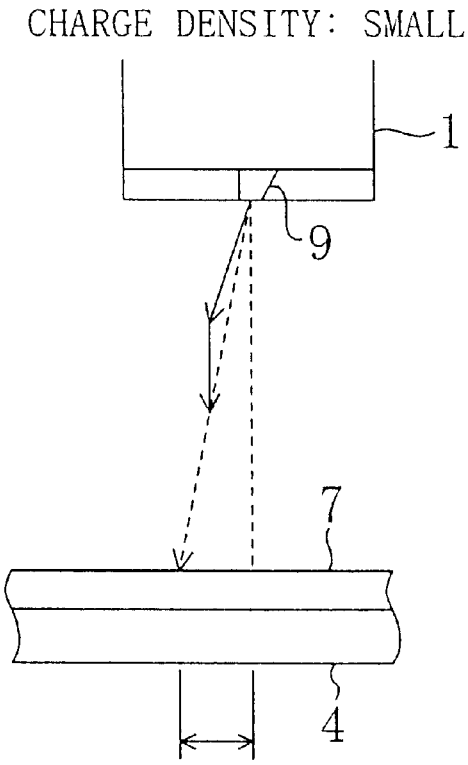
FIG. 20, comprised of FIGS. 20A and 20B, shows relationships between the charge density and the landing-position variation amount.
Figure 20B:
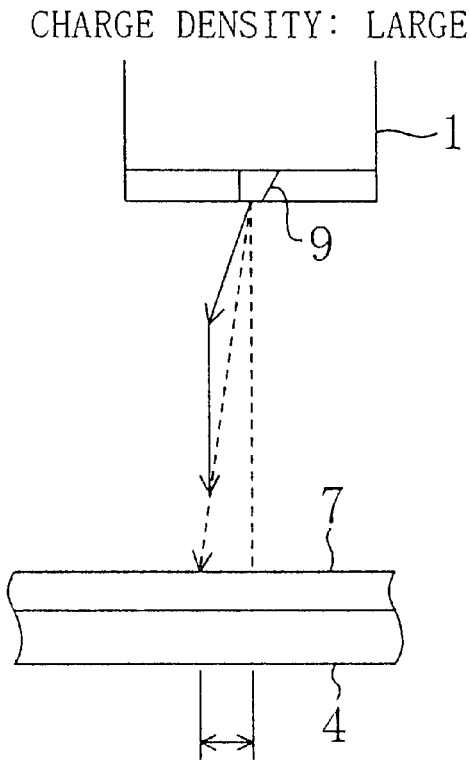
Figure 21B:
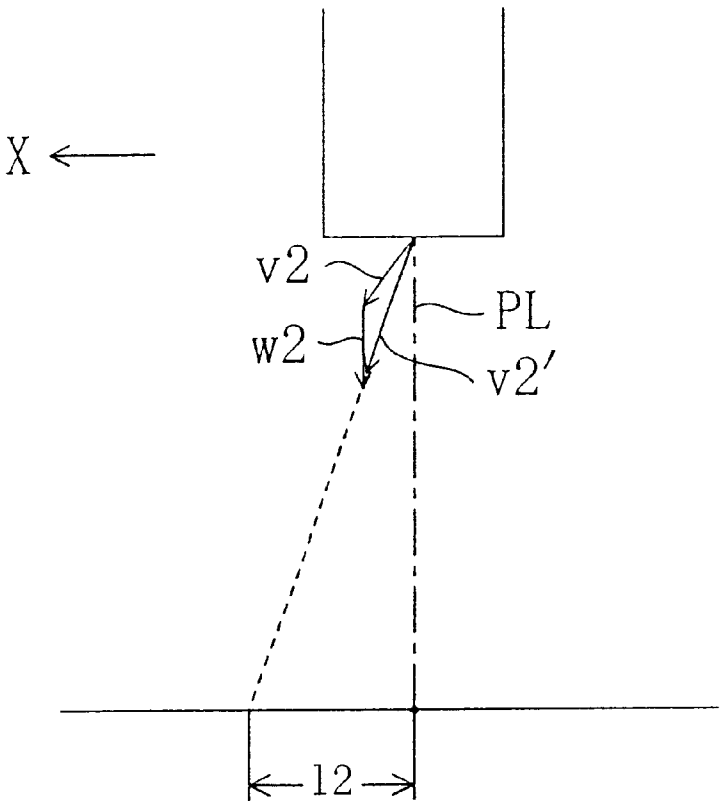
FIG. 21, comprised of FIGS. 21A and 21B, shows relationships between the emission velocity and the landing position relative to the principal scanning direction.
Figure 21A:
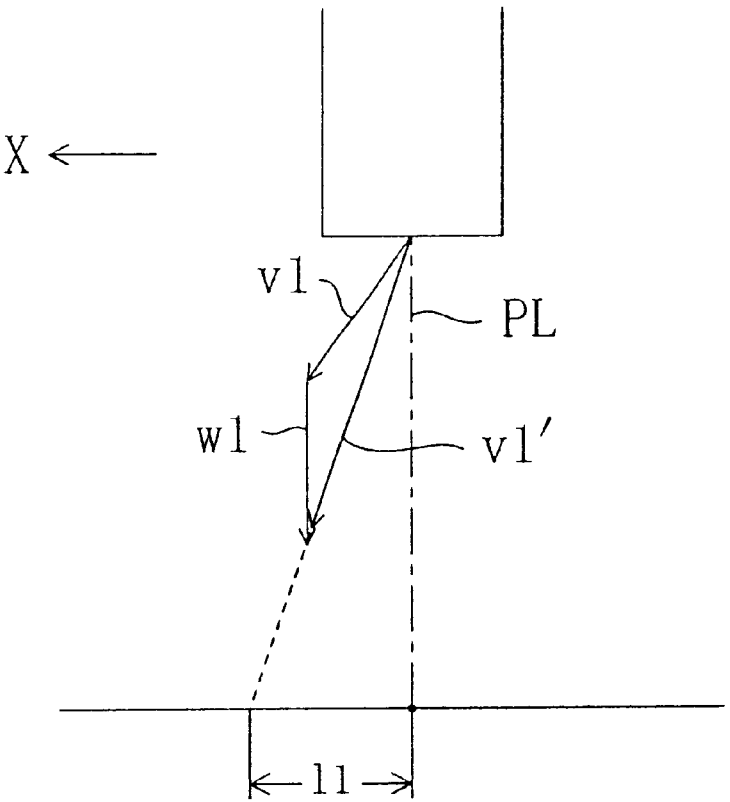

As shown in FIG. 20A, when charge amount is small (i.e., when charge density is small), the amount of landing position deviation from a point directly under the nozzle 9 is relatively great because the degree of acceleration by an electric field is small. On the other hand, as shown in FIG. 20B, when charge amount is great (i.e., when charge density is great), the landing-position deviation amount is relatively small because the degree of acceleration by an electric field is great. Therefore, a first ink droplet of a smaller charge amount and a second ink droplet of a greater charge amount are emitted during one print cycle, thereby making it possible to form two dots in the secondary scanning direction during one print cycle.

Deflection Control

In accordance with the fifth embodiment, during one print cycle of T, the first ink droplet small in the charge amount is first emitted and thereafter, the second ink droplet great in the charge amount is emitted. Each ink droplet is emitted at intervals of T/2, as in the first embodiment.

Effects of the Fifth Embodiment

As a result of arrangement described above, the fifth embodiment also provides the same effects that the first embodiment does. Additionally, it is designed such that after the first ink droplet of a smaller charge amount is emitted, the second ink droplet of a larger charge amount is emitted, which makes it possible to diminish the amount of landing position deviation in the principal scanning direction accompanied with the movement of the carriage 2.

Variation Example

Also, the number of ink droplets which are to be emitted during one print cycle is not limited to two (2) in the present embodiment. An arrangement may be employed in which three or more ink droplets of different charge amounts are emitted during one print cycle.

In order to prevent the occurrence of white striping, it may be arranged such that the charge amount of at least one of the first and second ink droplets is varied over a plurality of print cycles.

Embodiment 6

In a sixth embodiment of the invention, the opening direction of the nozzle 9 is in nonparallel with a virtual plane formed by a scanning direction and an electric field direction, as in the first to fifth embodiments. In addition, in the sixth embodiment, the nozzle opening direction is also in nonparallel with a virtual plane perpendicular to the scanning direction.

Generally, as the ink droplet diameter increases, the emission velocity likewise increases, in other words, as the ink droplet diameter decreases, the emission velocity likewise decreases. For this reason, with the movement of the carriage 2, a landing position deviation in the principal scanning direction due to the emission velocity, occurs.

To cope with the above problem, the nozzle opening is inclined towards the direction in which the carriage 2 advances during print operation by a predetermined angle β from a virtual plane PL perpendicular to the scanning direction. Note that the predetermined angle β is set to a value of 12 degrees here.

Although the emission velocity (v1) of a larger ink droplet is higher than the emission velocity (v2) of a smaller ink droplet, its charge amount is greater than that of the smaller ink droplet, so that the acceleration component (w1) thereof is greater than the acceleration component (w2) of the smaller ink droplet. Accordingly, landing position deviation due to the difference in emission velocity will be offset by landing position deviation based on the difference in deflection amount by an electric field, as a result of which the landing positions of both the ink droplets are almost the same.

In accordance with the sixth embodiment, it becomes possible to have a larger-diameter ink droplet and a smaller-diameter ink droplet land at almost the same point, so that deviation of the landing position due to the movement of the carriage 2 can be prevented.

Embodiment 7

In a seventh embodiment of the invention according to the foregoing first to sixth embodiments, there is made a change in the pattern of forming a dot onto the recording paper sheet 7.

Figure 22:
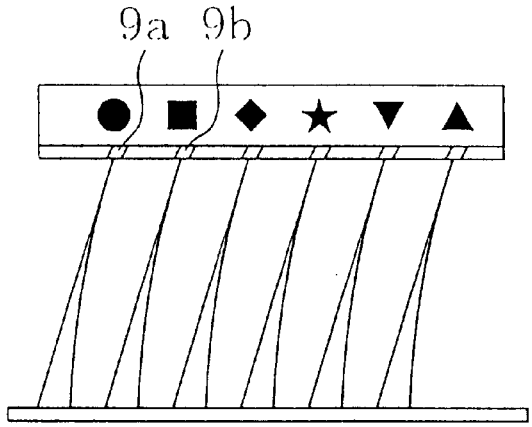
FIG. 22 is a cross-sectional view along the secondary scanning direction, showing in a mode form an ink jet head.
Figure 23:
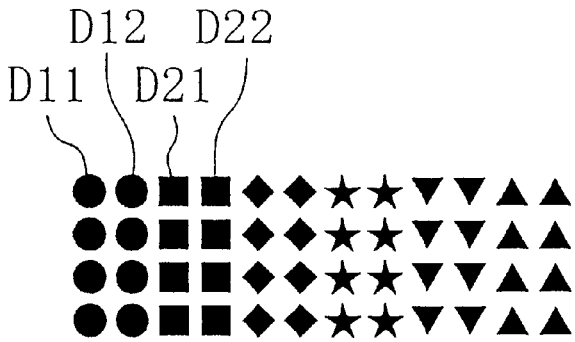
FIG. 23 is a diagram showing a dot pattern.
Figure 24:
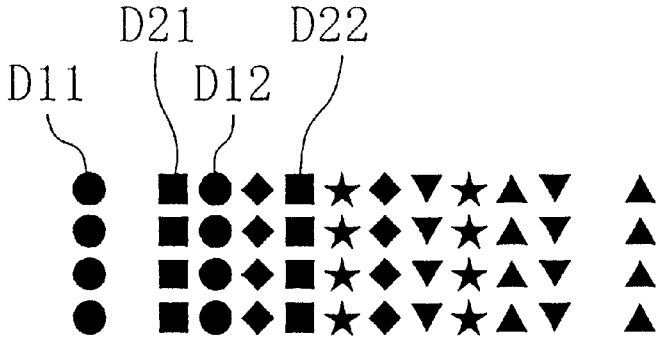
FIG. 24 is a diagram showing a dot pattern.

For the sake of providing a simplified description, nozzles 9*a,* 9*b,* and so on and corresponding dots D11, D12, D21, D22, and so on are represented, as shown in FIG. 22, by symbols such as ●, ■, ♦, ★, ▼, and ▲. As shown in FIG. 23, in each of the foregoing embodiments it is designed such that first and second ink droplets emitted from each nozzle form two dots arranged next to each other in the secondary scanning direction. For example, a first ink droplet emitted through the first nozzle 9*a* to form the first dot D11 and a second ink droplet emitted through the first nozzle 9*a* to form the second dot D12 are arranged next to each other in the secondary scanning direction. A row of ● dots formed of these first and second dots D11 and D12 (rows of ● dots vertically arranged in FIG. 23) are arranged side by side in the secondary scanning direction (i.e., in the lateral direction in FIG. 23).

On the other hand, in the seventh embodiment, it is designed such that the first dot D11 formed by a first ink droplet emitted from the first nozzle 9*a* and the second dot D12 formed by a second ink droplet emitted from the first nozzle 9*a* are not arranged next to each other, and that the third dot D21, which is formed by a first ink droplet emitted from the second nozzle 9*b,* locates between the first and second dots D11 and D12.

As described above, in accordance with the seventh embodiment, the first and second ink droplets emitted from the same nozzle are not formed side by side in the secondary scanning direction, therefore making it possible to effectively suppress the occurrence of white striping. For example, if ink droplets are emitted through the second nozzle 9*b,* having a diameter smaller than a predetermined diameter, then the third and fourth dots D21 and D22 formed by the ink droplets thus emitted are scattered without being arranged next to each other. The occurrence of a white stripe is suppressed accordingly.

Variation Example 1

The amount of landing position variation of two ink droplets emitted from each nozzle can be set to any values as long as these two ink droplets are not arranged next to each other in the secondary scanning direction. Such a variation amount is not limited to the above-described embodiment. Additionally, the number of ink droplets which are emitted from each nozzle is not limited to two (2). The number may be set to three (3) or more. For example, if each nozzle emits n ink droplets during one print cycle where the number n is a natural number equal to or greater than two (2), each ink droplet may be deviated by P+P/n where P is the nozzle pitch. Further, each droplet may be deviated by m×P+P/n, where the number m is a natural number equal to or greater than two (2).

Variation Example 2

Figure 25:
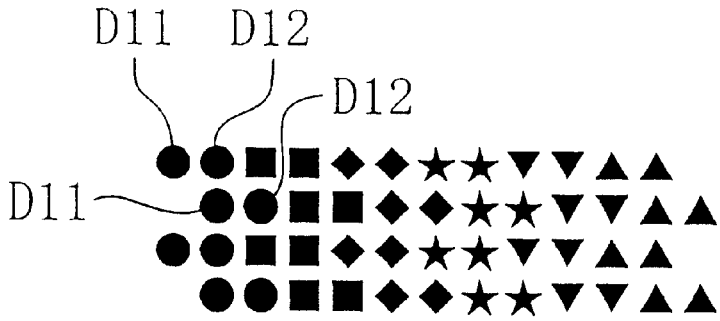
FIG. 25 is a diagram showing a dot pattern.

As shown in FIG. 25, it may be designed such that the first dot D11 formed by a first ink droplet and the second dot D12 formed by a second ink droplet are arranged next to each other in the secondary scanning direction, and that these two dots D11 and D12 snake-zigzag in the principal scanning direction. Such a dot pattern will be formed, for example, in the following way. In other words, the ink jet head 1 is constructed in such a way as to enable each nozzle to emit three kinds of ink droplets having different landing positions, wherein in a specific print cycle ink droplets are made to land on first and second landing positions, in a subsequent print cycle ink droplets are made to land on the second and third landing positions, and in the next print cycle ink droplets are made to land again on the first and second landing positions. These print cycles are repeated a plurality of times, as a result of which the aforesaid dot pattern will be formed easily.

Variation Example 3

Figure 26:
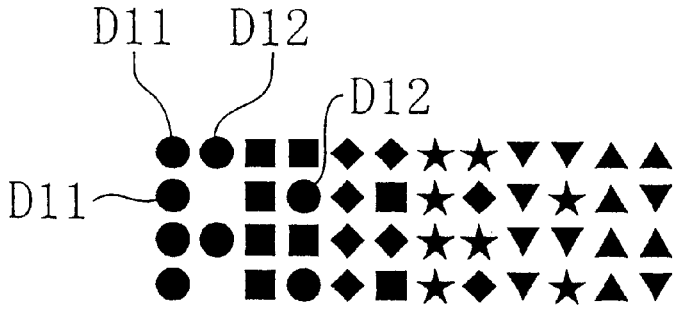
FIG. 26 is a diagram showing a dot pattern.

As shown in FIG. 26, it may be designed such that in a specific print cycle the first and second dots D11 and D12 are arranged next to each other in the secondary scanning direction, while on the other hand in another print cycle the first and second dots D11 and D12 are not arranged next to each other. Such a dot pattern can be formed in the same way as the second variation example.

Embodiment 8

In an eighth embodiment of the invention, landing-position variation control is employed not for the improvement in dot density but for preventing the occurrence of white striping.

Figure 27:
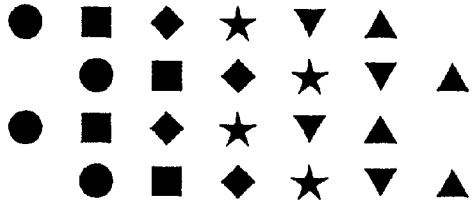
FIG. 27 is a diagram showing a dot pattern.

As shown in FIG. 27, in the eighth embodiment, each nozzle emits a single ink droplet during one print cycle and ink droplet landing position is varied periodically. Here, ink droplet landing position is varied for every two print cycles.

In accordance with the eighth embodiment, ink droplets emitted from the same nozzle are not arranged next to each other, thereby making it possible to suppress the occurrence of white striping.

Embodiment 9

Figure 28A:
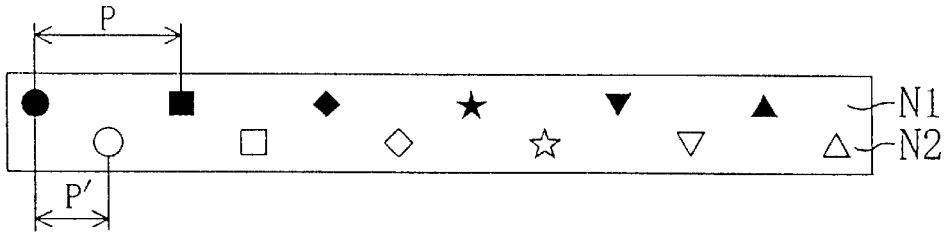
FIG. 28A is a top view showing in a model form an arrangement of nozzles.

In a ninth embodiment of the invention, there is made a change to the ink jet head 1 and a nozzle arrangement structure is employed in which nozzles are formed in a zigzag pattern as shown in a model form by FIG. 28A.

Referring to FIG. 28A, an ink jet head formed in accordance with the ninth embodiment is provided with first and second nozzle rows N1 and N2, each of the nozzle rows N1 and N2 comprising a plurality of nozzles arranged at a predetermined pitch P in the secondary scanning direction. The pitch (P') between nozzles of the first nozzle row N1 and their corresponding adjoining nozzle of the second nozzle row N2 is set to a value of P/2. Accordingly, the present ink jet head has an increased nozzle density twice that of the ink jet head 1 of the first embodiment. Each of the nozzles is constructed in such a way so as to emit two ink droplets during one print cycle.

Figure 28B:
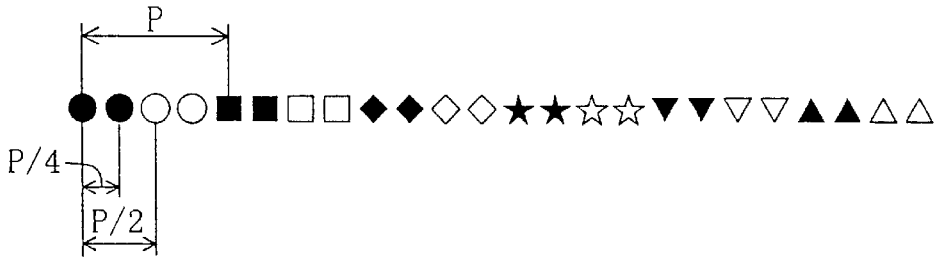
FIG. 28B is a diagram showing a pattern of dots.

As shown in FIG. 28B, if the amount of variation in the landing position of ink droplets emitted from each nozzle is set to a value of P/4, then the dot density is increased to be fourfold. In this case, high-density recording becomes possible with a less deflection amount.

Accordingly, much higher-density recording can be accomplished by (a) providing n rows of nozzles, (b) setting the inter-nozzle pitch P' between nozzles of one of the n nozzle rows and their corresponding adjoining nozzles of another of the n nozzle rows to a value of P/n, (c) causing each nozzle to emit m ink droplets during one print cycle, and (d) setting the amount of landing position deviation of each of the ink droplets to a value of P/(m×n), where both the numbers m and n are natural numbers not less than two (2).

Variation Example

Figure 29A:
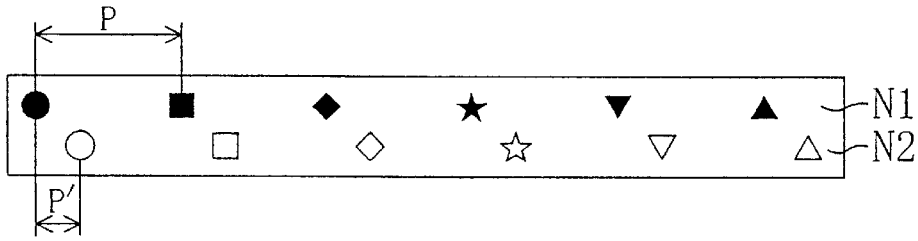
FIG. 29A is a top view showing in a model form an arrangement of nozzles.

As shown in a model form by FIG. 29A, the pitch P', i.e., the pitch between nozzles of the first nozzle row N1 and their adjoining nozzles of the second nozzle row N2 may be set to a value of P/4 (P'=P/4), thereby forming a special zigzag pattern. Also in this case, it is designed such that each nozzle emits two droplets during one print cycle, and the amount of landing position variation of the ink droplets is set to a value of P/2.

Figure 29B:
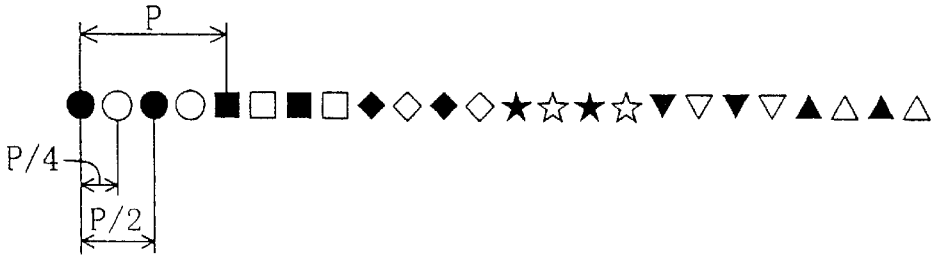
FIG. 29B is a diagram showing a pattern of dots.

As a result, as shown in FIG. 29B, the ink droplets are arranged at a pitch of P/4. Similar to the ninth embodiment, it becomes possible to provide high print quality of characters or images. Further, in the present variation example, since the two dots D11 and D12 formed of two ink droplets emitted from each nozzle are not arranged next to each other in the secondary scanning direction, thereby suppressing the occurrence of white striping. That is to say, in accordance with the present variation example, not only high-density recording is accomplished, but also the occurrence of white striping can be suppressed.

Further, much higher-density recording can be accomplished while suppressing the occurrence of white striping by (a) providing n rows of nozzles, (b) setting the inter-nozzle pitch between each nozzle of one of the n nozzle rows and its adjoining nozzle of another of the n nozzle rows, i.e., the pitch P', to a value of P/(2n), (c) causing each nozzle to emit m ink droplets during one print cycle, and (d) setting the amount of landing position deviation of each of the ink droplets to a value of P/n, where both the numbers m and n are natural numbers not less than two (2).

Embodiment 10

In a tenth embodiment of the invention, it is designed such that a plurality of ink droplets land on a recording paper sheet while deviating them in the secondary scanning direction, to form a dot D1 of an elliptic shape which is elongated in the secondary scanning direction (hereinafter called the elliptic dot).

Figure 30A:
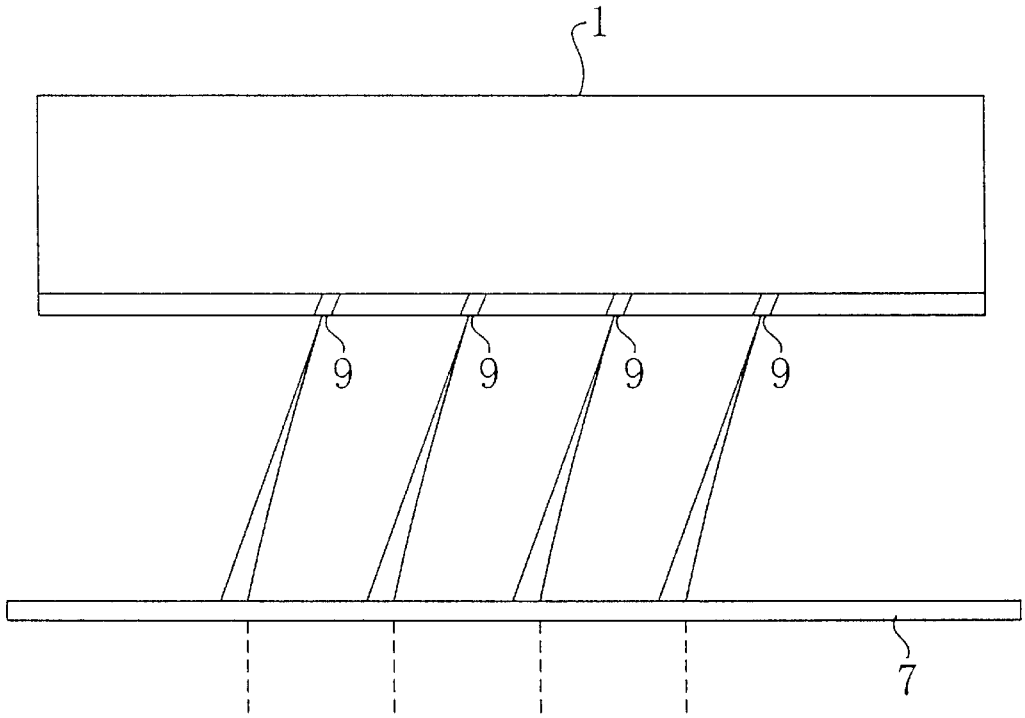
FIG. 30A is a cross-sectional view along the secondary scanning direction, showing in a model form an ink jet head.
Figure 30B:
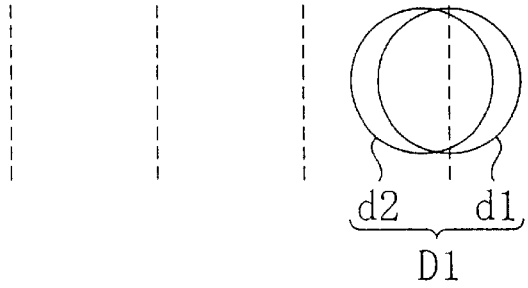
FIG. 30B is a diagram showing dot shapes.

As shown in FIG. 30, in the tenth embodiment, two ink droplets (d1 and d2) are emitted during one print cycle. It is set such that the landing positions of the first and second ink droplets d1 and d2 are deviated, so that these two ink droplets are overlapped in part with each other.

As a result of such arrangement, it becomes possible to reduce the gap defined between elliptic dots arranged next to each other in the secondary scanning direction, thereby reducing the occurrence of white striping. Particularly, if elliptic dots arranged next to each other in the secondary scanning direction are contacted together, this prevents a white stripe from occurring. This makes it possible to provide higher print quality.

Embodiment 11

In an eleventh embodiment of the invention, elliptic dots D1 and D2 are formed which are elongated in the principal scanning direction.

Figure 31A:
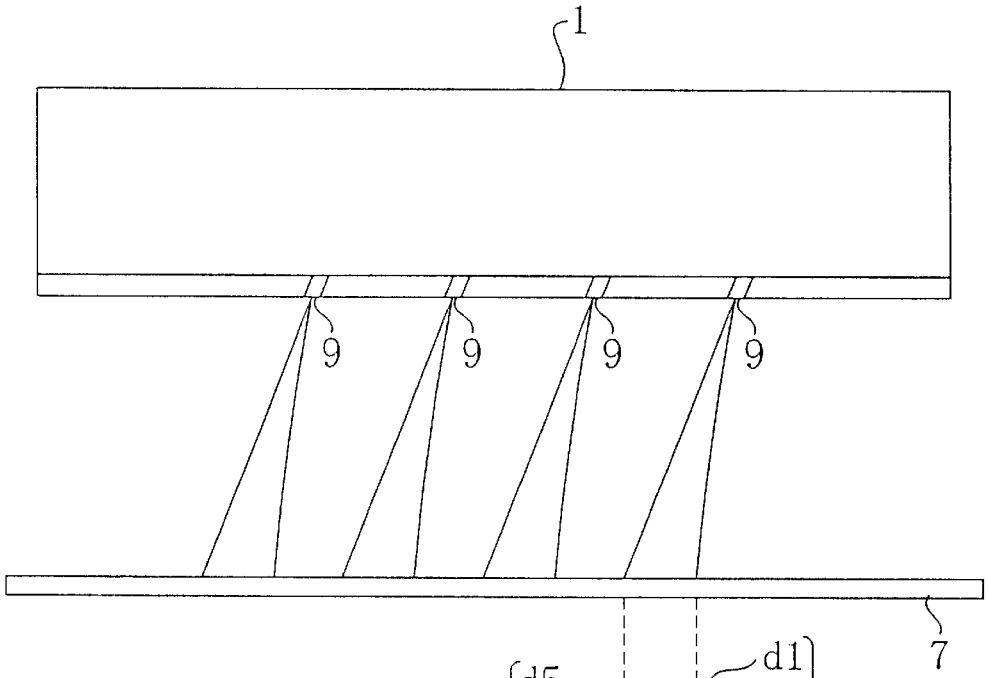
FIG. 31A is a cross-sectional view along the secondary scanning direction, showing in a model form an ink jet head.
Figure 31B:
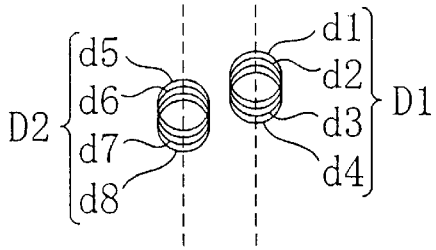
FIG. 31B is a diagram showing dot shapes.

As shown in FIG. 31, in the eleventh embodiment, first to eighth ink droplets d1–d8 are sequentially emitted during one print cycle. Each ink droplet is emitted at predetermined intervals according to the movement in the principal scanning direction so that the landing positions of the ink droplets are deviated by a predetermined distance in the principal scanning direction. More specifically, the first to fourth ink droplets d1–d4 (which makes up a first ink droplet group) each are deflected, together forming an elliptic dot D1 which is elongated in the principal scanning direction. On the other hand, the fifth to eighth ink droplets (which makes up a second ink droplet group) are not deflected, together forming an elliptic dot D2 which is located side by side with the elliptic dot D1 in the secondary scanning direction.

Accordingly, in accordance with the eleventh embodiment, it becomes possible not only to provide high-density recording but to also provide so-called overlap recording by causing ink droplets to land on the recording paper sheet in an overlapping manner. As a result, multi-gradation recording can be done.

Further, an arrangement may be employed in which the first ink droplet group forming the first dot D1 and the second ink droplet group forming the second dot D2 are alternately emitted. However, as in the present embodiment, it is arranged such that the ink droplets d5–d8 together forming the second dot D2 are emitted after all the ink droplets d1–d4 together forming the first dot D1 are emitted, which arrangement makes it possible to reduce the length of the dots D1 and D2 in the principal scanning direction.

Embodiment 12

Figure 32:
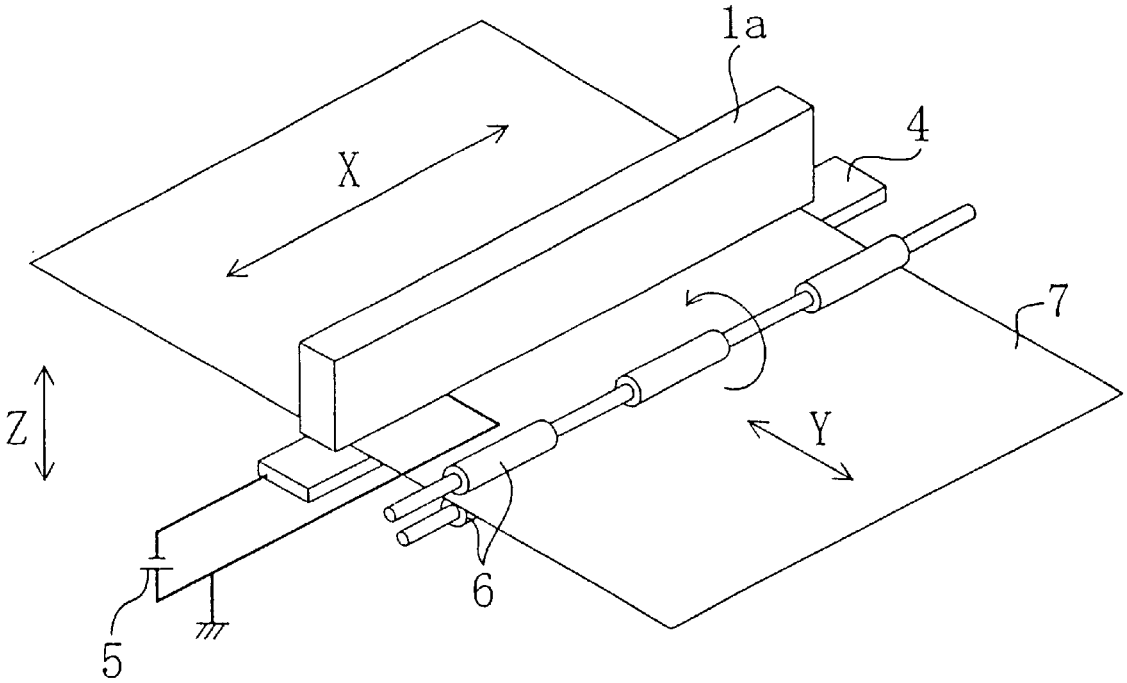
FIG. 32 is a diagram roughly showing a structure of an ink jet recording apparatus.

As shown in FIG. 32, a twelfth embodiment of the invention is directed to a recording apparatus having a so-called full-line head. More specifically, an ink jet head 1*a* of the present embodiment is formed in such a way as to laterally run across the recording paper sheet 7. Nozzles 9 of the ink jet head 1*a* are arranged in such a way as to extend in a lateral direction relative to the recording paper sheet 7 (i.e., a direction X shown in FIG. 32).

At the time of recording on the recording paper sheet 7, the paper feeding roller 6 conveys the recording paper sheet 7 in a scanning direction (i.e., a direction Y shown in FIG. 32), and a plurality of dots are formed on the recording paper sheet 7 by the ink jet head 1*a*. A recording method, i.e., a method of forming dots on the recording paper sheet 7, can be performed in the same way as in the first to eleventh embodiments. The present embodiment makes it possible to perform printing of characters or images all over the recording paper sheet 7 with a single scanning operation.

Incidentally, prior art full-line heads have the great difficulty in providing high-density recording and preventing the occurrence of white striping. The reason is as follows. A full line head completes a recording on the recording paper sheet 7 by a single scanning operation. Repeating such a scanning operation a plurality of times results in increasing not only the size of apparatus but also the cost, which is unpractical. Accordingly, by implementing the ink jet head 1*a* in the form of a full-line head, it becomes possible to provide high-density recording. In addition, the effect of preventing the occurrence of white striping in the present invention will be exhibited more significantly.

Other Embodiments

It is to be noted that the range of application of the present invention is not limited to so-called piezoelectric type recording apparatus typical examples of which are disclosed in the aforesaid first to twelfth embodiments. The present invention is, needless to say, applicable to bubble type recording apparatus in which droplets of ink are emitted by bubbles created by rapid application of heat to the ink.

It will be appreciated by those of ordinary skill in the art that the invention can be embodied in other specific forms without departing from the spirit or essential character thereof.

The presently disclosed embodiments are therefore considered in all respects to be illustrative and not restrictive. The scope of the invention is indicated by the appended claims rather than the foregoing description, and all changes which come within the meaning and range of equivalence thereof are intended to be embraced therein.

What is claimed is:

1. An ink jet recording apparatus comprising:

an ink jet head having a nozzle through which a droplet of ink is emitted, relative movement means for causing said ink jet head and a recording medium placed face to face with said nozzle to relatively move in a scanning direction, with a specified clearance maintained between said nozzle and said recording medium, a facing electrode disposed face to face with said nozzle in such a way as to put said recording medium between said nozzle and said facing electrode, voltage applying means for electrifying an ink droplet emitted from said nozzle and for applying a voltage between said nozzle and said facing electrode thereby to create an electric field, said nozzle is formed in such a way as to emit an ink droplet in a direction nonparallel with a virtual plane formed by said scanning direction and the direction of said electric field, and landing position varying means which is capable of varying a landing position of an ink droplet emitted from said nozzle in a direction normal to said scanning direction on said recording medium, by deflecting a flying direction of the ink droplet by an electric field created between the nozzle and the facing electrode.

2. The ink jet recording apparatus according to claim 1, wherein said ink jet head has a nozzle row of a plurality of nozzles arranged in a direction normal to said scanning direction, and said ink jet head is constructed such that each of said plurality of nozzles is capable of emitting two or more ink droplets during a print cycle of a given interval of time, and wherein said landing position varying means is constructed such that said two or more ink droplets emitted from each said nozzle during said print cycle land on different landing positions along a direction normal to said scanning direction on said recording medium.

3. The ink jet recording apparatus according to claim 2, wherein said landing position varying means is constructed such that said voltage applying means applies a plurality of voltages of different levels during one print cycle.

4. The ink jet recording apparatus according to claim 3, wherein a voltage which is applied by said voltage applying means is set in such a way as to vary at a period of 1/n of said print cycle, the number n being a natural number equal to or greater than two.

5. The ink jet recording apparatus according to claim 4, wherein a voltage which is applied by said voltage applying means in each print cycle is set in such a manner as to gradually increase in voltage level.

6. The ink jet recording apparatus according to claim 4, wherein the plurality of voltages which are applied by said voltage applying means during one print cycle include first and second voltages which differ in voltage level from each other, and wherein at least one of said first and second voltages is set in such a way to vary over a plurality of print cycles.

7. The ink jet recording apparatus according to claim 6, wherein said ink jet head has a plurality of nozzle rows arranged parallel with one another at given intervals of L in said scanning direction, wherein said relative movement means is constructed such that said ink jet head and said recording medium are relatively moved at a given relative velocity v, and wherein at least one of said first and second voltages which are applied by said voltage applying means is set in such a way as to vary at a period of $T1=L/v\times n$, the number n being a natural number.

8. The ink jet recording apparatus according to claim 3, wherein the plurality of voltages which are applied by said voltage applying means comprise voltages of the same polarity.

9. The ink jet recording apparatus according to claim 2, wherein said ink jet head has a pressure chamber in communication with said nozzle for containing therein ink and pressurizing means for applying a pressure to said ink held in said pressure chamber so that said ink is emitted in the form of an ink droplet through said nozzle, and wherein said landing position varying means is implemented by pressure varying means capable of varying the amount of pressure of said pressurizing means so that said nozzle is able to freely emit a plurality of ink droplets of different emission velocities during one print cycle.

10. The ink jet recording apparatus according to claim 9, wherein said pressure varying means is constructed such that, during one print cycle, a plurality of ink droplets are emitted from the same nozzle at the same emission volume and at different emission velocities.

11. The ink jet recording apparatus according to claim 9, wherein said pressure varying means is constructed such that a plurality of ink droplets emitted from the same nozzle during one print cycle form at least first and second dots of the same diameter on said recording medium, wherein said first dot is formed of two or more ink droplets, while said second dot is formed of a single ink droplet, and wherein each of said ink droplets together forming said first dot is emitted at a lower emission velocity in comparison with said droplet forming said second dot.

12. The ink jet recording apparatus according to claim 9, wherein said pressurizing means is constructed such that said pressure amount varies at a period of 1/n of a print cycle, the number n being a natural number equal to or greater than two.

13. The ink jet recording apparatus according to claim 12, wherein said pressurizing means is constructed such that the pressure amount gradually increases during each print cycle.

14. The ink jet recording apparatus according to claim 9, wherein said pressurizing means includes an oscillating plate which forms at least one of walls of said pressure chamber and a piezoelectric element for displacing said oscillating plate upon application of a voltage to said piezoelectric element, and wherein said pressure varying means is constructed such that the amount of pressure by said oscillating plate is varied by varying a waveform of a voltage which is applied to said piezoelectric element.

15. The ink jet recording apparatus according to claim 2, wherein said landing position varying means is formed by charge amount varying means for varying the amount of ink droplet electrification so as to freely emit a plurality of ink droplets of different charge amounts during one print cycle.

16. The ink jet recording apparatus according to claim 15, wherein said charge amount varying means is constructed such that the amount of charge which is given during each print cycle gradually increases.

17. The ink jet recording apparatus according to claim 1, wherein said nozzle of said ink jet head is formed such that an ink droplet is emitted in a direction nonparallel with a virtual plane perpendicular to said scanning direction.

18. The ink jet recording apparatus according to claim 1, wherein said ink jet head has a nozzle row of a plurality of nozzles arranged at a given pitch of P in a direction normal to said scanning direction, and said ink jet head is constructed such that each of said plurality of nozzles is able to emit n ink droplets during a print cycle of a given interval of time, the number n being a natural number equal to or greater than two, and wherein said landing position varying means is constructed such that landing positions of n ink droplets emitted through each of said plurality of nozzles during said print cycle are deviated by P/n in a direction normal to said scanning direction.

19. The ink jet recording apparatus according to claim 1, wherein said ink jet head has a nozzle row of a plurality of nozzles arranged at a given pitch of P in a direction normal to said scanning direction, and said ink jet head is constructed such that each of said plurality of nozzles is able to emit n ink droplets during a print cycle of a given interval of time, the number n being a natural number equal to or greater than two, and wherein said landing position varying means is constructed such that landing positions of n ink droplets emitted through each of said plurality of nozzles during said print cycle are deviated by $P \times m + P/n$ in a direction normal to said scanning direction, the number m being a natural number.

20. The ink jet recording apparatus according to claim 1, wherein said ink jet head has a nozzle row of a plurality of nozzles arranged at a given pitch of P in a direction normal to said scanning direction, and said ink jet head is constructed such that each of said plurality of nozzles is able to emit two ink droplets during a print cycle of a given interval of time, wherein said landing position varying means is constructed such that the landing positions of two ink droplets which are emitted from each of said plurality of nozzles can be varied among first to third landing points deviated each other by P/2 in a direction normal to said scanning direction on said recording medium, and in a first print cycle, two ink droplets which are emitted from each of said plurality of nozzles land on said first and second landing points respectively, while in a second print cycle posterior to said first print cycle, two ink droplets which are emitted from each of said plurality of nozzles land on said second and third landing points respectively, and wherein said first and second print cycles are set so as to be repeated in an alternating manner.

21. The ink jet recording apparatus according to claim 1, wherein said ink jet head has a nozzle row of a plurality of nozzles arranged at a given pitch of P in a direction normal to said scanning direction, and said ink jet head is constructed such that each of said plurality of nozzles can emit two ink droplets during a print cycle of a given interval of time, wherein said landing position varying means is constructed such that the landing positions of two ink droplets emitted from each of said plurality of nozzles can be varied among a first landing point on said recording medium, a second landing point deviating from said first landing point by 0.5 P in a direction normal to said scanning direction, and a third landing point deviating from said first landing point by 1.5 P in said direction normal to said scanning direction, and in a first print cycle, two ink droplets emitted from each of said plurality of nozzles land on said first and second landing points respectively, while in a second print cycle posterior to said first print cycle, two ink droplets emitted from each of said plurality of nozzles land on said second and third landing points respectively, and wherein said first and second print cycles are set so as to be repeated in an alternating manner.

22. The ink jet recording apparatus according to claim 1, wherein said ink jet head includes at least first and second nozzle rows, each of said first and second nozzle rows comprising a plurality of nozzles arranged at a given pitch P in a direction normal to said scanning direction, and said ink jet head is constructed such that each said nozzle can emit at least two ink droplets during a print cycle of a given interval of time, wherein said first nozzle row includes a first nozzle for forming at least first and second dots on said recording medium, wherein said second nozzle row includes a second nozzle adjacent to said first nozzle for forming at least third and fourth dots on said recording medium, and wherein said second dot is set to lie between said third dot and said fourth dot, while said third dot is set to lie between said first dot and said second dot.

23. The ink jet recording apparatus according to claim 1, wherein said landing position varying means is constructed such that, in order to form a dot which is elongated in a direction normal to said scanning direction on said recording medium, a plurality of ink droplets which are emitted from each nozzle during one print cycle land on said recording medium in an overlapping manner while being deviated in said direction normal to said scanning direction.

24. The ink jet recording apparatus according to claim 1, wherein said ink jet head is constructed such that each of said nozzles can emit first and second ink droplet groups during one print cycle, each of said first and second ink droplet groups being formed of two or more ink droplets, wherein it is set such that said ink droplets of said first ink droplet group each land on said recording medium in an overlapping manner while being deviated in said scanning direction, to form on said recording medium a first dot which is elongated in said scanning direction, and wherein said ink droplets of said second ink droplet group each are emitted after said emission of said first ink droplet group in such a way as to differ in landing point from said first ink droplet group, and land on said recording medium in an overlapping manner while being deviated in said scanning direction, thereby to form a second dot which is elongated in said scanning direction at a position located a given interval apart from said first dot in a direction normal to said scanning direction.

25. The ink jet recording apparatus according to claim 1, wherein said ink jet head includes a nozzle row of a plurality of nozzles arranged in a direction normal to said scanning direction, and said ink jet head is constructed such that each of said plurality of nozzles can emit a single ink droplet during a print cycle of a given interval of time, and wherein said landing position varying means is constructed such that the landing position of each of said ink droplets with respect to said recording medium is varied in a direction normal to said scanning direction for each print cycle.

* * * * *